US012667749B2

(12) United States Patent
Perry et al.

(10) Patent No.: US 12,667,749 B2
(45) Date of Patent: Jun. 30, 2026

(54) EXERCISE MACHINE LINE SPOOL

(71) Applicant: Tonal Systems, Inc., San Francisco, CA (US)

(72) Inventors: Joseph Perry, San Jose, CA (US); David Jonathan Zimmer, Exeter, CA (US); Anya Richardson Quenon, San Francisco, CA (US); David Mallard, Mill Valley, CA (US); Colin Russell Parker, San Francisco, CA (US)

(73) Assignee: Tonal Systems, Inc., San Francisco, CA (US)

( * ) Notice: Subject to any disclaimer, the term of this patent is extended or adjusted under 35 U.S.C. 154(b) by 221 days.

(21) Appl. No.: 18/244,709

(22) Filed: Sep. 11, 2023

(65) Prior Publication Data

US 2024/0108939 A1 Apr. 4, 2024

Related U.S. Application Data

(63) Continuation-in-part of application No. 18/107,859, filed on Feb. 9, 2023, and a continuation-in-part of application No. 17/550,753, filed on Dec. 14, 2021, now Pat. No. 12,350,546.

(60) Provisional application No. 63/308,656, filed on Feb. 10, 2022, provisional application No. 63/125,923, filed on Dec. 15, 2020.

(51) Int. Cl.
*A63B 21/00* (2006.01)
*A63B 21/005* (2006.01)

(52) U.S. Cl.
CPC ..... *A63B 21/153* (2013.01); *A63B 21/0058* (2013.01); *A63B 21/154* (2013.01)

(58) Field of Classification Search
CPC . A63B 21/153; A63B 21/0058; A63B 21/154; A63B 21/169; A63B 21/4035; A63B 2220/54; A63B 2220/805; A63B 2220/806; A63B 21/4043; A63B 23/03541; A63B 21/156
See application file for complete search history.

(56) References Cited

U.S. PATENT DOCUMENTS

| | | | |
|---|---|---|---|
| 4,471,956 | A | 9/1984 | Marlo |
| 4,968,028 | A | 11/1990 | Wehrell |
| 4,998,721 | A | 3/1991 | Anders |
| 6,120,423 | A | 9/2000 | Mackey |

(Continued)

FOREIGN PATENT DOCUMENTS

| | | |
|---|---|---|
| EP | 3202465 | 8/2017 |
| KR | 101160960 | 6/2012 |

(Continued)

OTHER PUBLICATIONS

Spool Definition & Meaning, Dictionary.com, https://www.dictionary.com/browse/spool#google_vignette, 2024, 1 page.

*Primary Examiner* — Andrew M Kobylarz
(74) *Attorney, Agent, or Firm* — Van Pelt, Yi & James LLP

(57) ABSTRACT

A weight training machine comprises: a motor; a line that is tensioned by the motor; a spool that takes up the line, wherein the spool includes a flange wherein the flange defines a capture region for the line; and a line guide adjacent to the spool, wherein the line guide prevents the line from persistently escaping from the capture region for the line.

9 Claims, 17 Drawing Sheets

(56) References Cited

U.S. PATENT DOCUMENTS

| | | | | |
|---|---|---|---|---|
| 6,280,361 | B1 | 8/2001 | Harvey | |
| 6,312,363 | B1 | 11/2001 | Watterson | |
| 6,482,139 | B1 | 11/2002 | Haag | |
| 7,163,488 | B2 | 1/2007 | Anders | |
| 7,278,958 | B2 | 10/2007 | Morgan | |
| 7,568,650 | B2 * | 8/2009 | Barker | B66D 1/38 242/397.2 |
| 7,717,824 | B2 | 5/2010 | Pinto | |
| 7,753,830 | B1 | 7/2010 | Marsh | |
| 7,909,742 | B2 | 3/2011 | Ish, III | |
| 8,029,425 | B2 | 10/2011 | Bronston | |
| 8,900,099 | B1 | 12/2014 | Boyette | |
| 9,101,791 | B2 | 8/2015 | Boyette | |
| 9,539,458 | B1 | 1/2017 | Ross | |
| 9,814,920 | B1 | 11/2017 | Monterrey | |
| 10,220,235 | B2 * | 3/2019 | Norris | A63B 21/153 |
| 10,814,172 | B1 | 10/2020 | Ilfrey | |
| 11,007,398 | B2 | 5/2021 | Neuhaus | |
| 11,040,231 | B2 | 6/2021 | Rubin | |
| 11,130,022 | B1 | 9/2021 | Loduca | |
| 11,298,577 | B2 | 4/2022 | Watterson | |
| 11,478,676 | B2 | 10/2022 | Loduca | |
| 11,504,570 | B2 | 11/2022 | Neuhaus | |
| 11,541,264 | B1 | 1/2023 | Mallard | |
| 12,090,359 | B1 | 9/2024 | Gonzalez | |
| 12,285,649 | B2 | 4/2025 | Ye | |
| 12,311,214 | B2 | 5/2025 | Mooney | |
| 2004/0033866 | A1 | 2/2004 | Shapiro | |
| 2004/0242383 | A1 | 12/2004 | Karlstrom | |
| 2004/0254050 | A1 | 12/2004 | Morgan | |
| 2009/0029835 | A1 | 1/2009 | Ellis | |
| 2011/0275481 | A1 | 11/2011 | Greenhill | |
| 2012/0197168 | A1 | 8/2012 | Agrawal | |
| 2013/0303334 | A1 | 11/2013 | Adhami | |
| 2013/0310230 | A1 | 11/2013 | Joshua | |
| 2014/0038777 | A1 | 2/2014 | Bird | |
| 2014/0073492 | A1 | 3/2014 | Hunter | |
| 2015/0335951 | A1 | 11/2015 | Eder | |
| 2016/0101322 | A1 * | 4/2016 | Potter | A63B 21/153 482/6 |
| 2016/0332019 | A1 | 11/2016 | Rollins | |
| 2016/0346601 | A1 | 12/2016 | Marcandelli | |
| 2017/0027803 | A1 | 2/2017 | Agrawal | |
| 2017/0035642 | A1 | 2/2017 | Sugata | |
| 2017/0319941 | A1 | 11/2017 | Smith | |
| 2018/0021622 | A1 | 1/2018 | Holland | |
| 2018/0214729 | A1 | 8/2018 | Rubin | |
| 2018/0264306 | A1 | 9/2018 | Agrawal | |
| 2018/0296879 | A1 | 10/2018 | Blium | |
| 2019/0046830 | A1 | 2/2019 | Chiavegato | |
| 2019/0076691 | A1 | 3/2019 | Smith | |
| 2019/0083351 | A1 | 3/2019 | Suzuki | |
| 2019/0344115 | A1 | 11/2019 | Neuhaus | |
| 2019/0344123 | A1 | 11/2019 | Rubin | |
| 2020/0047027 | A1 | 2/2020 | Ward | |
| 2020/0047030 | A1 | 2/2020 | Ward | |
| 2020/0047031 | A1 | 2/2020 | Orady | |
| 2020/0047053 | A1 | 2/2020 | Ward | |
| 2020/0047054 | A1 | 2/2020 | Ward | |
| 2020/0047055 | A1 | 2/2020 | Ward | |
| 2020/0054929 | A1 | 2/2020 | Ward | |
| 2020/0094096 | A1 | 3/2020 | Sorin | |
| 2020/0139186 | A1 | 5/2020 | Sorin | |
| 2020/0139187 | A1 | 5/2020 | Kennington | |
| 2020/0197741 | A1 | 6/2020 | Lee | |
| 2020/0222266 | A1 | 7/2020 | Gordon | |
| 2020/0254295 | A1 | 8/2020 | Watterson | |
| 2020/0332990 | A1 | 10/2020 | Bayerlein | |
| 2021/0111646 | A1 | 4/2021 | Rubin | |
| 2021/0128978 | A1 | 5/2021 | Gilstrom | |
| 2021/0236874 | A1 | 8/2021 | Ward | |
| 2021/0236876 | A1 | 8/2021 | Gregory | |
| 2021/0339078 | A1 * | 11/2021 | Akeel | A63B 21/4035 |
| 2022/0062738 | A1 | 3/2022 | Neuhaus | |
| 2022/0105378 | A1 | 4/2022 | Chiavegato | |
| 2022/0134171 | A1 | 5/2022 | Loduca | |
| 2022/0184452 | A1 | 6/2022 | Valente | |
| 2022/0233907 | A1 | 7/2022 | Cobb | |
| 2022/0323815 | A1 | 10/2022 | Simental | |
| 2022/0370854 | A1 | 11/2022 | Zhang | |
| 2022/0409950 | A1 | 12/2022 | Zhu | |
| 2023/0009699 | A1 | 1/2023 | Ferlito | |
| 2023/0067732 | A1 | 3/2023 | Neuhaus | |
| 2023/0103725 | A1 | 4/2023 | Neuhaus | |
| 2023/0149778 | A1 | 5/2023 | Hendricks | |
| 2023/0166952 | A1 * | 6/2023 | Hall | B66D 1/26 254/333 |
| 2023/0201652 | A1 | 6/2023 | Ye | |
| 2023/0241448 | A1 | 8/2023 | Loduca | |
| 2023/0405404 | A1 | 12/2023 | Belsham | |
| 2024/0189651 | A1 * | 6/2024 | Drayer | A63B 23/03516 |
| 2025/0177800 | A1 * | 6/2025 | Herring | A63B 21/023 |

FOREIGN PATENT DOCUMENTS

| | | |
|---|---|---|
| KR | 101482222 | 1/2015 |
| WO | 2014139336 | 9/2014 |
| WO | 2021151127 A1 | 8/2021 |

* cited by examiner

EXERCISE MACHINE LINE SPOOL

CROSS REFERENCE TO OTHER APPLICATIONS

This application is a continuation in part of U.S. patent application Ser. No. 17/550,753 entitled FLOOR-BASED EXERCISE MACHINE CONFIGURATIONS filed Dec. 14, 2021, which is incorporated herein by reference for all purposes, which claims priority to U.S. Provisional Application No. 63/125,923, entitled FLOOR-BASED EXERCISE MACHINE CONFIGURATIONS filed Dec. 15, 2020 which is incorporated herein by reference for all purposes.

This application is a continuation in part of U.S. patent application Ser. No. 18/107,859 entitled DUAL MOTOR EXERCISE MACHINE filed Feb. 9, 2023, which is incorporated herein by reference for all purposes, which claims priority to U.S. Provisional Application No. 63/308,656, entitled DUAL MOTOR EXERCISE MACHINE filed Feb. 10, 2022 which is incorporated herein by reference for all purposes.

BACKGROUND OF THE INVENTION

Strength training, also referred to as resistance training or weight lifting, is an important part of a fitness routine. It promotes the building of muscle, the burning of fat, and improvement of a number of metabolic factors including insulin sensitivity and lipid levels. Many users seek a more efficient and safe strength training regime that includes a line-based weight training machine.

BRIEF DESCRIPTION OF THE DRAWINGS

Various embodiments of the invention are disclosed in the following detailed description and the accompanying drawings.

DETAILED DESCRIPTION

Figure 1:
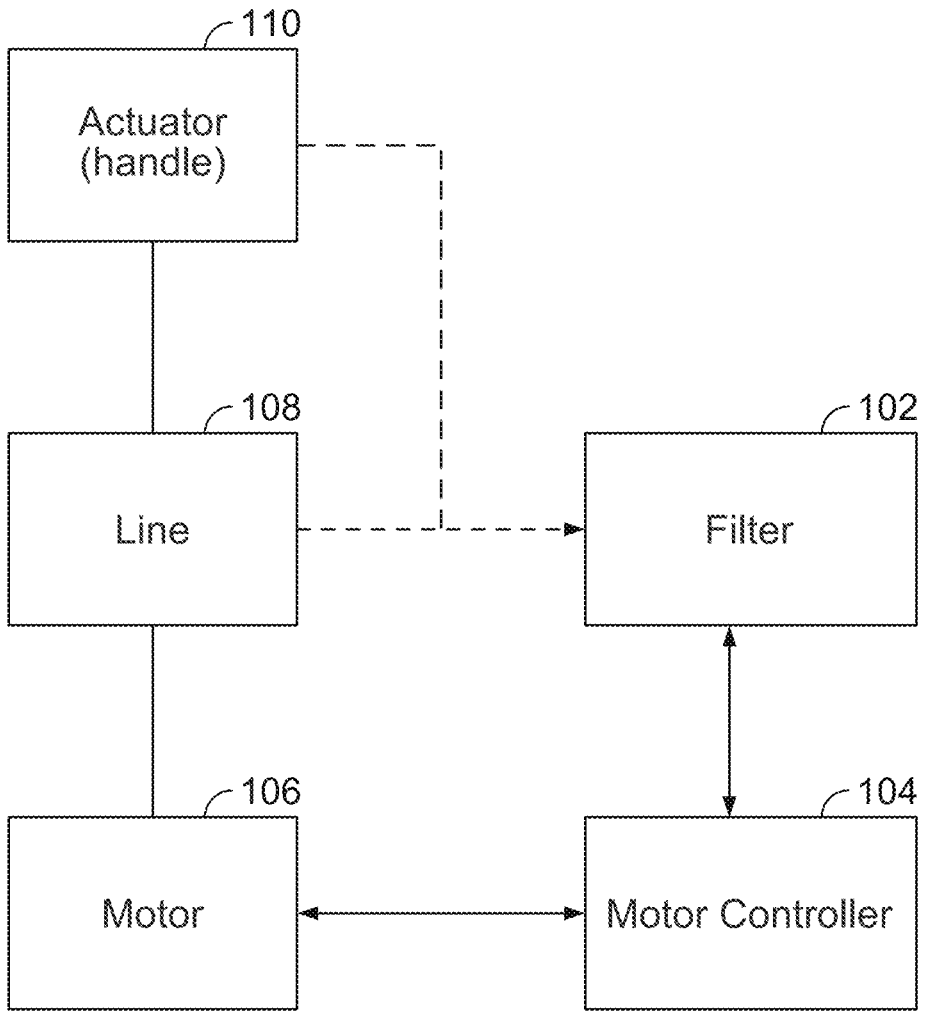
FIG. 1 is a block diagram illustrating an embodiment of an exercise machine capable of digital strength training.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

An improved line-based weight training machine is disclosed that reduces line jamming, line friction, and/or line wear due to a slack line around a spool. Line jamming, line friction, and/or line wear may negatively affect the efficiency or safety of the weight training regime for a user.

In one embodiment, the weight training machine comprises a motor wherein the torque of the motor is associated with resistance for the exercise machine, for example, emulating a "digital weight" for the user of the exercise machine. The disclosed techniques may thus be used with any exercise machine where a line is used with a spool, for example using a digital weight training machine as described in U.S. Pat. No. 10,335,626 entitled EXERCISE MACHINE WITH PANCAKE MOTOR filed Oct. 2, 2017, US Patent Publication No. US2022/0184452 entitled FLOOR-BASED EXERCISE MACHINE CONFIGURATIONS filed Dec. 14, 2021, and/or U.S. patent application Ser. No. 18/107,859 entitled DUAL MOTOR EXERCISE MACHINE filed Feb. 9, 2023, all of which are incorporated herein by reference for all purposes. Any person of ordinary skill in the art understands that the line guidance techniques may be used without limitation with other machines that include a line and a spool, and the weight training exercise configuration given herein is merely illustrative and without limitation in the example embodiment.

FIG. 1 is a block diagram illustrating an embodiment of an exercise machine capable of digital strength training. The exercise machine includes the following:

- a controller circuit (104), which may include a processor, inverter, pulse-width-modulator, and/or a Variable Frequency Drive (VFD);
- a motor (106), for example a three-phase AC driven by the controller circuit;
- a spool with a line (108) wrapped around the spool and coupled to the spool. On the other end of the line an actuator/handle (110) is coupled in order for a user to grip and pull on. The spool is coupled to the motor (106) either directly or via a shaft/belt/chain/gear mechanism. Throughout this specification, a spool may be also referred to as a "hub";
- a filter (102), to digitally control the controller circuit (104) based on receiving information from the line (108) and/or actuator (110);
- optionally (not shown in FIG. 1) a gearbox between the motor and spool. Gearboxes multiply torque and/or friction, divide speed, and/or split power to multiple spools. Without changing the fundamentals of digital strength training, a number of combinations of motor and gearbox may be used to achieve the same end result. A line-pulley system may be used in place of a gearbox, and/or a dual motor may be used in place of a gearbox;
- one or more of the following sensors (not shown in FIG. 1): a position encoder; a sensor to measure position of the actuator (110). Examples of position encoders include a hall effect shaft encoder, grey-code encoder on the motor/spool/line (108), an accelerometer in the actuator/handle (110), optical sensors, position measurement sensors/methods built directly into the motor (106), and/or optical encoders. In one embodiment, an optical encoder is used with an encoding pattern that uses phase to determine direction associated with the low resolution encoder. Other options that measure back-EMF (back electromagnetic force) from the motor (106) in order to calculate position also exist;
- a motor power sensor; a sensor to measure voltage and/or current being consumed by the motor (106);
- a user tension sensor; a torque/tension/strain sensor and/or gauge to measure how much tension/force is being applied to the actuator (110) by the user. In one embodiment, a tension sensor is built into the line (108). Alternatively, a strain gauge is built into the motor mount holding the motor (106). As the user pulls on the actuator (110), this translates into strain on the motor mount which is measured using a strain gauge in a Wheatstone bridge configuration. In another embodiment, the line (108) is guided through a pulley coupled to a load cell. In another embodiment, a belt coupling the motor (106) and line spool or gearbox (108) is guided through a pulley coupled to a load cell. In another embodiment, the resistance generated by the motor (106) is characterized based on the voltage, current, or frequency input to the motor.

In one embodiment, a three-phase AC motor (106) is used with the following:

- a controller circuit (104) combined with filter (102) comprising:
  - a processor that runs software instructions;
  - three pulse width modulators (PWMs), each with two channels, modulated at 20 kHz;
  - six transistors in an H-Bridge configuration coupled to the three PWMs;
  - optionally, two or three ADCs (Analog to Digital Converters) monitoring current on the H-Bridge; and/or
  - optionally, two or three ADCs monitoring back-EMF voltage;
- the three-phase AC motor (106), which may include a synchronous-type and/or asynchronous-type permanent magnet motor, such that:
  - the motor (106) may be in an "out-runner configuration" as described below;
  - the motor (106) may have a maximum torque output of at least 60 Nm and a maximum speed of at least 300 RPMs;
  - optionally, with an encoder or other method to measure motor position;
- a line (108) wrapped around the body of the motor (106) such that entire motor (106) rotates, so the body of the motor is being used as a line spool in one case. Thus, the motor (106) is directly coupled to a line (108) spool. In one embodiment, the motor (106) is coupled to a line spool via a shaft, gearbox, belt, and/or chain, allowing the diameter of the motor (106) and the diameter of the spool to be independent, as well as introducing a stage to add a set-up or step-down ratio if desired. Alternatively, the motor (106) is coupled to two spools with an apparatus in between to split or share the power between those two spools. Such an apparatus could include a differential gearbox, or a pulley configuration; and/or
- an actuator (110) such as a handle, a bar, a strap, or other accessory connected directly, indirectly, or via a connector such as a carabiner to the line (108).

In some embodiments, the controller circuit (102, 1004) is programmed to drive the motor in a direction such that it draws the line (108) towards the motor (106). The user pulls on the actuator (110) coupled to line (108) against the direction of pull of the motor (106).

One purpose of this setup is to provide an experience to a user similar to using a traditional line-based strength training machine, where the line is attached to a weight stack being acted on by gravity. Rather than the user resisting the pull of gravity, they are instead resisting the pull of the motor (106).

Note that with a traditional line-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast in a digital strength trainer, there is no actual weight stack. The notion of the weight stack is one modeled by the system. The physical embodiment is an actuator (110) coupled to a line (108) coupled to a motor (106). A "weight moving" is instead translated into a motor rotating. As the circumference of the spool is known and how fast it is rotating is known, the linear motion of the line may be calculated to provide an equivalency to the linear motion of a weight stack. Each rotation of the spool equals a linear motion of one circumference or 2πr for radius r. Likewise, torque of the motor (106) may be converted into linear force by multiplying it by radius r.

If the virtual/perceived "weight stack" is moving away from the ground, motor (106) rotates in one direction. If the "weight stack" is moving towards the ground, motor (106) rotates in the opposite direction. Note that the motor (106) is pulling towards the line (108) onto the spool. If the line (108) is unspooling, it is because a user has overpowered the motor (106). Thus, note a distinction between the direction the motor (106) is pulling, and the direction the motor (106) is actually turning.

If the controller circuit (102, 1004) is set to drive the motor (106) with, for example, a constant torque in the direction that spools the line, corresponding to the same direction as a weight stack being pulled towards the ground, then this translates to a specific force/tension on the line (108) and actuator (110). Calling this force "Target Tension", this force may be calculated as a function of torque multiplied by the radius of the spool that the line (108) is wrapped around, accounting for any additional stages such as gear boxes or belts that may affect the relationship between line tension and torque. If a user pulls on the actuator (110) with more force than the Target Tension, then that user overcomes the motor (106) and the line (108) unspools moving towards that user, being the virtual equivalent of the weight stack rising. However, if that user applies less tension than the Target Tension, then the motor (106) overcomes the user and the line (108) spools onto and moves towards the motor (106), being the virtual equivalent of the weight stack returning.

AC Motor. While many motors exist that run in thousands of revolutions per second, an application such as fitness equipment designed for strength training has different requirements and is by comparison a low speed, high torque type application suitable for a AC motor.

In one embodiment, a requirement of such a motor (106) is that a line (108) wrapped around a spool of a given diameter, directly coupled to a motor (106), behaves like a 200 lbs weight stack, with the user pulling the line at a maximum linear speed of 62 inches per second. A number of motor parameters may be calculated based on the diameter of the spool.

nets are placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style". As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As described herein, a pancake motor is between 15 and 60 centimeters in diameter, for example 22 centimeters in diameter, with a depth between 6 and 15 centimeters, for example a depth of 6.7 centimeters.

Motors may also be "direct drive", meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternately, a 2:1 gear ratio may be used to accomplish the same thing. Likewise, the diameter of the spool may be adjusted to accomplish the same.

Alternately, a motor with 100× the speed and 100th the torque may also be used with a 100:1 gearbox. As such a gearbox also multiplies the friction and/or motor inertia by 100×, 3 Atorque control schemes become challenging to design for fitness equipment/strength training applications. Friction may then dominate what a user experiences. In other applications friction may be present, but is low enough that it is compensated for, but when it becomes dominant, it

| User Requirements | | | | | | |
|---|---|---|---|---|---|---|
| Target Weight | 200 lbs | | | | | |
| Target Speed | 62 inches/sec = 1.5748 meters/sec | | | | | |
| Requirements by Spool Size | | | | | | |
| | Diameter (inches) | | | | | |
| | 3 | 5 | 6 | 7 | 8 | 9 |
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

Thus, a motor with 67.79 Nm of force and a top speed of 395 RPM, coupled to a spool with a 3 inch diameter meets these requirements. 395 RPM is slower than most motors available, and 68 Nm is more torque than most motors on the market as well.

Hub motors are three-phase permanent magnet AC direct drive motors in an "out-runner" configuration: throughout this specification out-runner means that the permanent magis difficult to control for. For these reasons, direct control of motor speed and/or motor position as with AC motors is more appropriate for fitness equipment/strength training systems.

Figure 2:
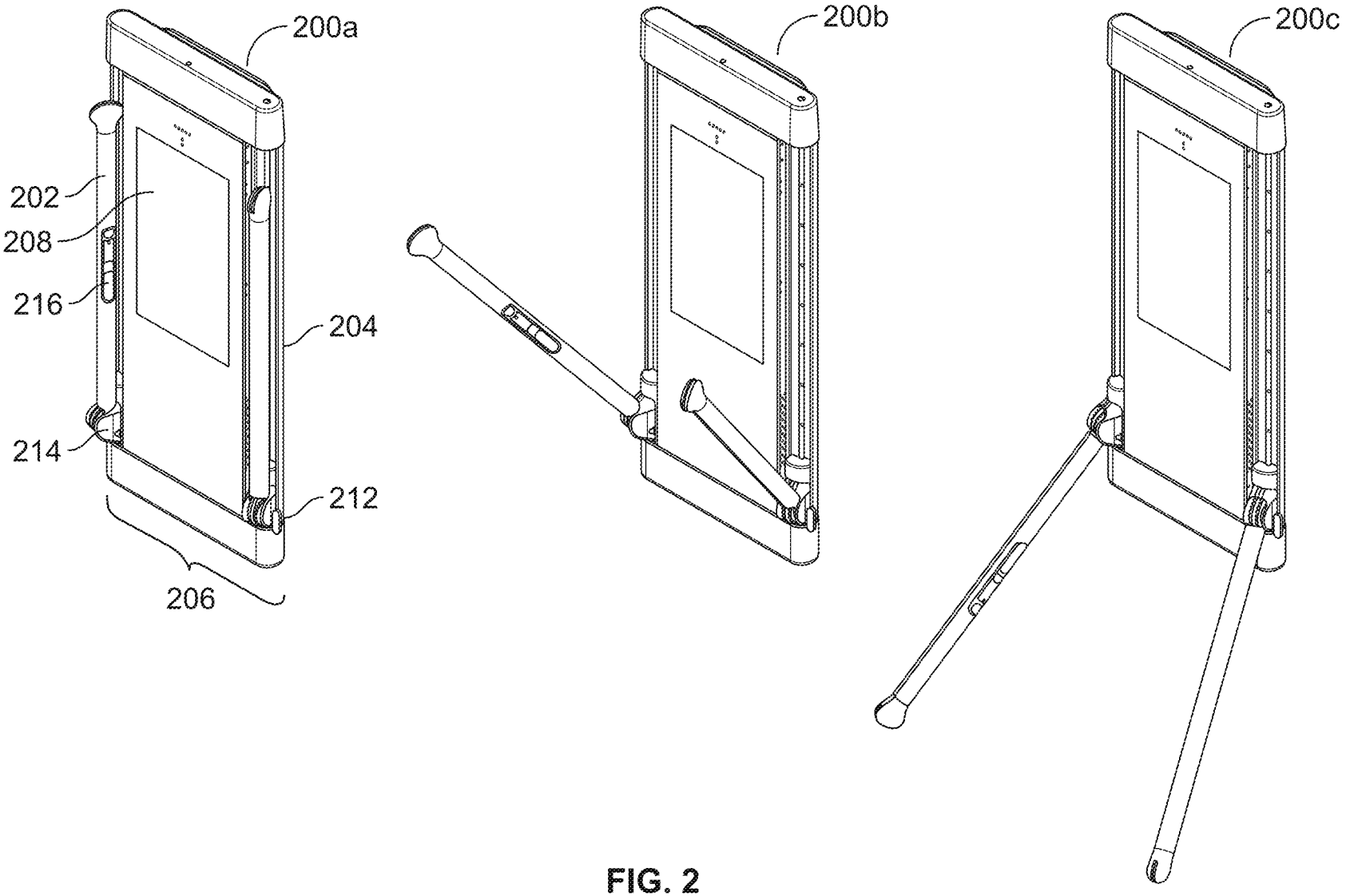
FIG. 2 includes front perspective views of an embodiment of a weight training machine.

Multi-Spool Based Embodiments. FIG. 2 includes front perspective views of an embodiment of a weight training machine. In one embodiment, the machine of FIG. 2 is the exercise machine capable of digital strength training represented in a block diagram in FIG. 1. In the example of FIG. 2, the exercise machine has two arms.

FIG. 2 illustrates an exercise machine with the arms (202) and (204) in a stowed position, where the arms are upright in stowed position (200*a*). FIG. 2 also shows two other positions: first where the exercise machine with the arms vertically pivoted outwards, or angled away from the body of the exercise machine, pointing in an upwards direction (200*b*), and second where the arms are in mid-vertical pivot, pointing in a downwards direction (200*c*).

In this example, control (216) includes controls for unlocking the adjustment of the position of arm (202). In one embodiment, arm (204) also includes a corresponding set of controls. The arms may be independently pivoted to any angle as appropriate.

The exercise machine of FIG. 2 is an embodiment of a digital strength trainer that may use one or two motors as load elements to provide electronic resistance. In the case of a single motor, a differential gearbox may be used. One or two spools may be used with the one or two motors.

In one embodiment, lines travel within the arms, where one end of a line in a given arm is coupled or otherwise connected to a motor, which may be in the body of the exercise machine. In one embodiment, at the distal end of an arm, away from the body/central console (206) of the trainer, is a handle attached to one end of the line. A handle is but one example of an actuator that may be used by a user to perform exercise.

In one embodiment, the exercise machine is mounted to a wall. In one embodiment, the exercise machine is floor mounted. The exercise machine may also be a combination of wall/floor mounted. For example, the exercise machine may be mounted to the wall as well as bolted to the floor. The exercise machine may also stand on the floor while being wall mounted. In one embodiment, the exercise machine is freestanding. For example, the exercise machine is attached to a moveable stand, where the stand need not be hard mounted.

In one embodiment, the exercise machine includes one or more of: an antenna, a camera, other optical sensors, depth sensors, infrared sensors, a display, a touch screen, a touch screen controller, an audio input device, a microphone, an audio output device, a speaker, a motor controller, one or more electric motors, one or more spools, one or more lines, and actuators such as handles. The body (206) may include a screen (208).

The motor controller, the handles, and the electric motor are exemplary controllers, exercising components/actuators, and resistive devices/load elements, respectively. In one embodiment, the exercise machine includes multiple motors, for example one per arm. The machine shown in FIG. 2 may have two motors/spools, where an embodiment of a four arm exercise machine (not shown) may have four motors/spools.

In one embodiment, the exercise machine includes a central console (206) for controlling the exercise machine. The console may include a display (208). In one embodiment, the display is a touch screen. In such an example, the display allows instructional information such as virtual training content to be presented to the user and with which a user interacts. In one embodiment, to reduce the interference with an exercise routine that occurs whenever a user interacts with the exercise appliance/machine features or controls, controls are incorporated in the handle. For example, this is an improvement from a case where the user has to release one of the handles in order to use that hand to modify settings selected from options indicated at the display (208) or physical controls located at the control panel (206). Thus, by suitable location of the user controls and application of control context information, the user is able to alter the exercise machine settings with better efficiency to the exercise regime and/or better user safety.

In one embodiment, the exercise machine does not have a display and may be connected to a television or touch-screen monitor via a connection such as HDMI, USB, HDCP, and/or Displayport. In one embodiment, images, video, streaming, audiovisual content, and/or multimedia are transmitted wirelessly to an external display device or other receiver devices such as virtual reality sets, augmented reality sets, set top boxes, and/or game consoles. In one embodiment, data is sent to an application on a mobile device such as a tablet or smartphone, where the application then interprets and renders a user interface for interacting with the exercise machine and/or viewing exercise data measured by the exercise machine for example.

The arms of the exercise machine may have various degrees of freedom (DOFs). In the examples of FIG. 2, the arms of the exercise machine are each capable of moving in at least two directions: 1) horizontal pivot; and 2) vertical pivot (a rotation of the arm relative to the ground). As shown in the example of FIG. 2, the arms pivot vertically about points (212) and (214), which are also referred to herein as the "shoulders" of the exercise machine. In one embodiment, the arms of the exercise machine are each capable of moving in a third direction: translation such as sliding vertically up and down a track.

In one embodiment, the arms of the exercise machine may each have one, two, or three degrees of freedom: 1) vertical pivot, also referred to herein as arm vertical pivoting in the "sagittal" plane, 2) horizontal pivot, to rotate around the shoulder, and/or 3) telescoping of the arm, such as retraction/collapsing of the arm and extension of the arm.

In one embodiment, the arms of the exercise machine are angled outwards from the body (206) of the machine. For example, the arms (202, 204) are not, when extended, perpendicular to the body (206), but rather are slanted horizontally outwards. In one embodiment, angled arms are used in lieu of having an additional degree of freedom, for example, horizontal pivot of the arms, so the arms (202, 204) have two degrees of freedom with vertical pivot and telescoping.

By having the arms on a horizontal pivot angle, when the arms pivot, they start when pointed upward in their most compact/least wide configuration, and widen as they move downwards. This allows the distance between the arms to vary based on the pivot angle. The telescoping, along with the vertical pivot and angled out arms, allows for the arms to provide a large range of motion. The use of angled arms provides various benefits, for example, by simplifying the design of the arms and reducing complexity and cost, such as by removing the need to have mechanisms to allow the arms to pivot horizontally, but still retaining a similar amount of functionality as would be provided by implementing horizontal pivoting of the arms.

Floor-Based Embodiments. In one embodiment, the machine described in FIG. 1 includes ones wherein components such as motors are placed lower, such as near to or on the ground. Floor-based machines described herein have various benefits and/or improvements. For example, a floor-based configuration may be designed to not require arms (202, 204) that have degrees of freedom. The degrees of freedom of arms may be expensive, for example because the arms not only need to pass loads through them, but also be lockable and adjustable. Furthermore, the use of arms may necessitate wall mounting of an exercise machine, which may introduce further installation cost and complexity. Thus, the removal or non-use of such degrees of freedom may allow for less expensive and complex exercise machines while still providing a useful exercise regime.

In one embodiment, floor-based machines are used in conjunction with auxiliary pulleys and/or other line ends, so that users of the exercise machines and/or weight trainers are configured to pull down on a line coupled to a line, for example, retracting lines downward toward the floor. This may mimic the action of weights pulling downwards. In one embodiment, the user stands on the exercise machine. In one embodiment, the user sits on the exercise machine.

One example of a floor-based configuration of a weight machine is a platform or step. A platform configuration of a digital strength trainer has various benefits and/or improvements. For example, it may be portable since it need not be mounted. This allows the exercise machine to be stored away efficiently and/or safely.

Figure 3:
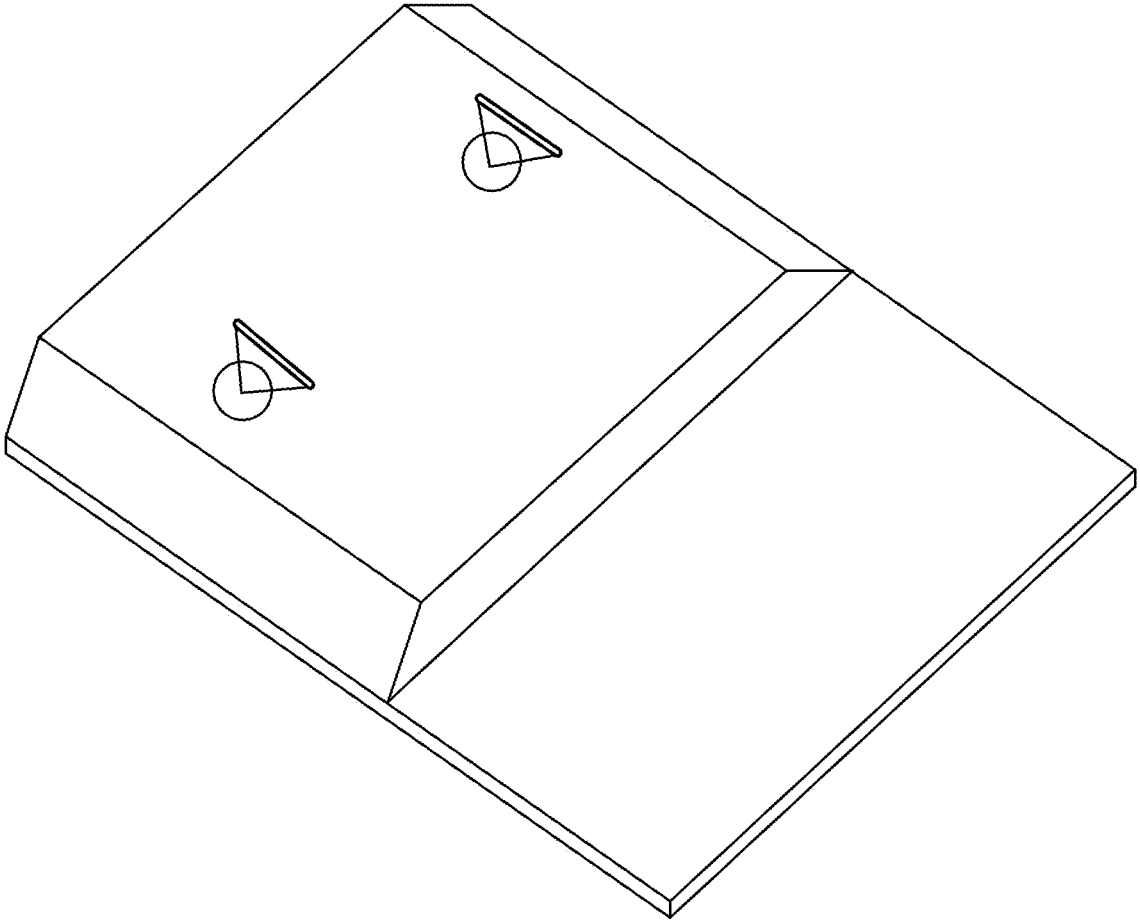
FIG. 3 illustrates an embodiment of a platform exercise machine.

FIG. 3 illustrates an embodiment of a platform exercise machine. In one embodiment, the platform includes an internal motor coupled to a line exiting the platform via a portal in an exit direction that transmits force to a remote handle. In one embodiment, the platform includes multiple internal motors coupled to respective lines exiting the platform via respective portals. For example, in the example of FIG. 3, the platform may include two internal motors, each coupled to respective lines that transmit force to respective actuators/handles. As another example, the platform includes a single internal motor and a differential/gearbox that allows power to be split to multiple lines.

Figure 4:
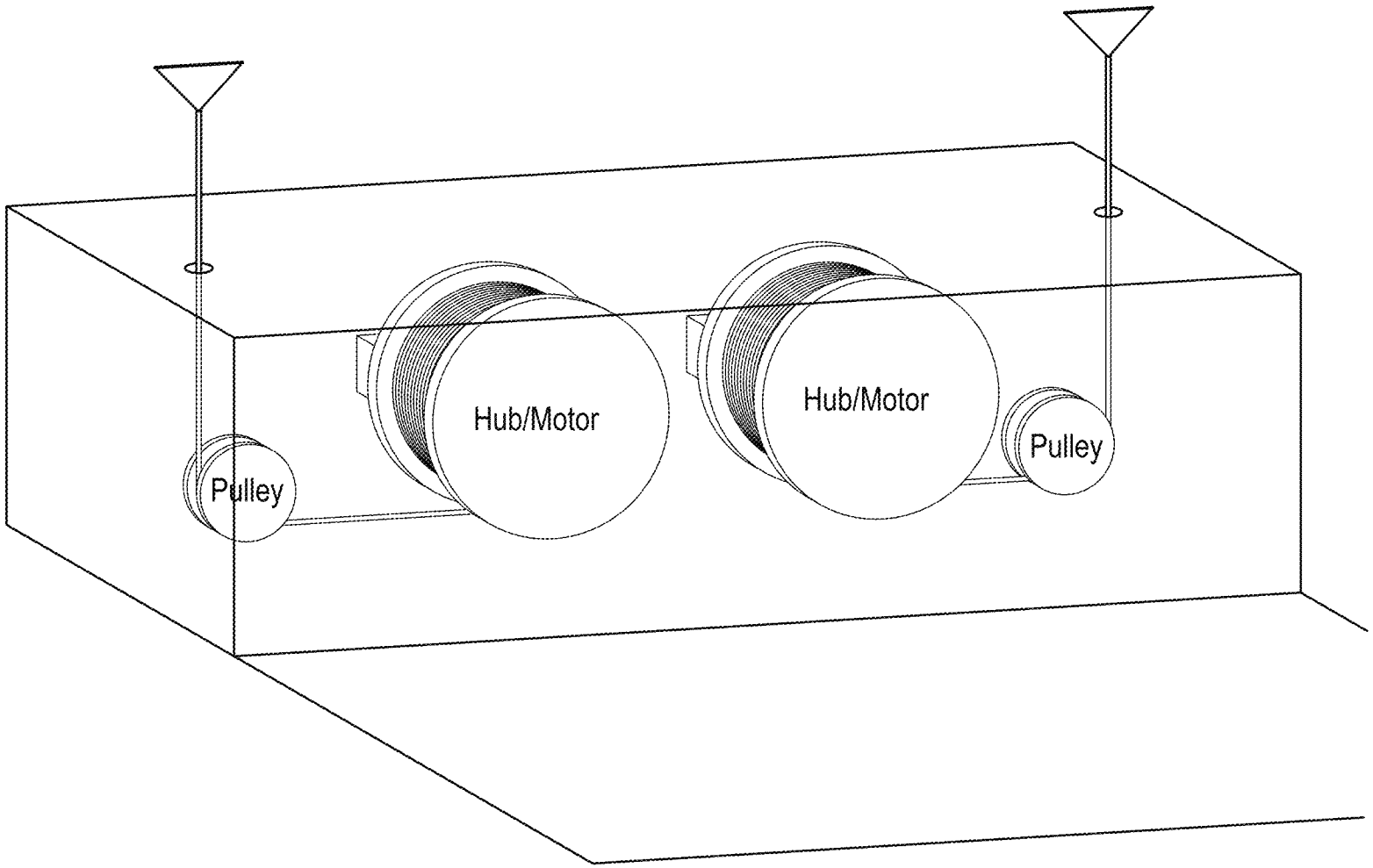
FIG. 4 illustrates an embodiment of a platform including a vertically mounted motor.

Floor-Mounted Machines with Vertically Mounted Motors. FIG. 4 illustrates an embodiment of a platform including a vertically mounted motor. In one embodiment, a vertically mounted motor is mounted within the platform such that its axis of rotation passes through the front of the platform. A combined hub and motor configuration is shown in the example of FIG. 4. In the example of FIG. 4, two motors are shown without limitation, but as described above one motor may be used, for example, with a differential gearbox, or more than two motors may be used.

One benefit of the vertical mounting of the motors is the reduction in number of pulleys. In one embodiment, the line directly spools on the motor and exits out of the platform, without the need for intermediary pulleys, for example, to translate from horizontal to vertical if using a horizontally mounted motor.

Motor Placement. Given the height of the motors when mounted vertically, consideration may be made as to where the motors are placed ergonomically in the platform so that its placement does not limit too many movements. In one embodiment, the motors and electronics are housed in a "bulge," where the platform also includes a larger plate that is lower to the ground that the user stands on.

In one embodiment, to accommodate the height of the vertically mounted motors, the platform includes a raised portion, where the raised portion is a localized area of the platform that is thicker and houses the motors. The platform may also include a thinner portion. In the example of FIG. 4, the platform includes a raised portion and a lower portion that is a flat plane. Components such as motors are included in the raised portion of the platform.

In one embodiment, when the platform is placed against a wall, the user may place their feet against a front of the raised portion of the platform, allowing them to perform exercises such as seated rows. The raised portion may also be used for exercises such as step ups. Thus, both high and low levels of the exercise platform may be utilized.

Internal Line Routing. In one embodiment, with the motors mounted vertically, each line is also spooled vertically. In this configuration, each line runs through the inside of the platform and up out of a respective exit point or portal in the top surface of the platform.

Floor Mounted Machines with Horizontally Mounted Motors. In one embodiment, the motors are each oriented/mounted horizontally. In one embodiment, a horizontally mounted motor is mounted within the platform such that its axis of rotation passes through a top and bottom of the platform. Horizontal mounting of the motors allows for a lower profile platform without, for example, the need for a raised portion or a tall platform to accommodate vertically mounted motors.

A lower platform provides various benefits and/or improvements, such as with respect to flexibility. For example, a lower platform is easier to store. As another example, a lower platform provides a user with a greater sense of stability.

Figure 5:
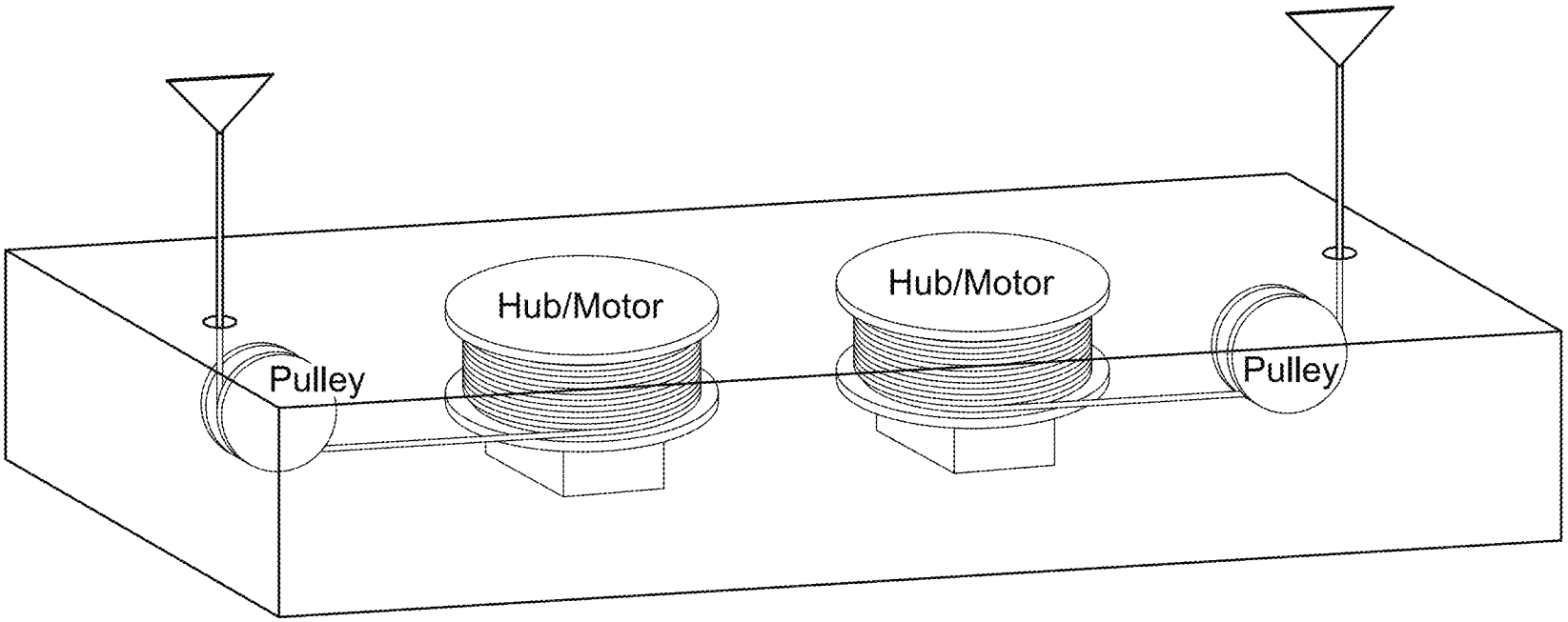
FIG. 5 illustrates an embodiment of a platform including a horizontally mounted motor.

FIG. 5 illustrates an embodiment of a platform including a horizontally mounted motor. In this example, relative to the vertically mounted motors described above, the horizontally mounted motors are turned sideways, where the line spools horizontally. In the example of FIG. 5, two motors are shown without limitation, but as described above one motor may be used, for example with a differential gearbox, or more than two motors may be used.

General Slack Prevention. Issues may arise when the line comes loose inside an exercise machine due to gravity acting in a different direction than the spooling and tension force. This gravity direction may depend on the mounting of the motor, whether mounted vertically, horizontally, or at an angle between vertically and horizontally.

For example, suppose that when the user is performing an exercise, the user accelerates when in the eccentric direction where the line is retracting. In this case, the user is moving inwards faster than the motor can take up the slack in the line, generating slack in the direction towards the machine.

Similarly, when the user is pulling out on the line and suddenly stops, this may result in an inertial issue in which slack is produced. The inertia of the motor causes the motor to continue to travel before torque regeneration may stop the motor and allow it to reverse. During that time frame, a slack condition is created, where there is no tension on the line, as the motor's inertia is greater than the torque that the motor is producing. Thus, the above two slack conditions are dependent on the maximum linear speed that may be imparted on the motor, as well as the inertia of the motor.

When the motor is mounted at an angle and/or horizontally and a slack condition occurs, the line may droop and fall, causing the line to no longer be inline with the spool/motor, in which case the line may then potentially become bound, jammed, and/or tangled. For example, when the line droops and the motor takes up the line, this may cause a large knot to form around the motor's axle.

Figure 6B:
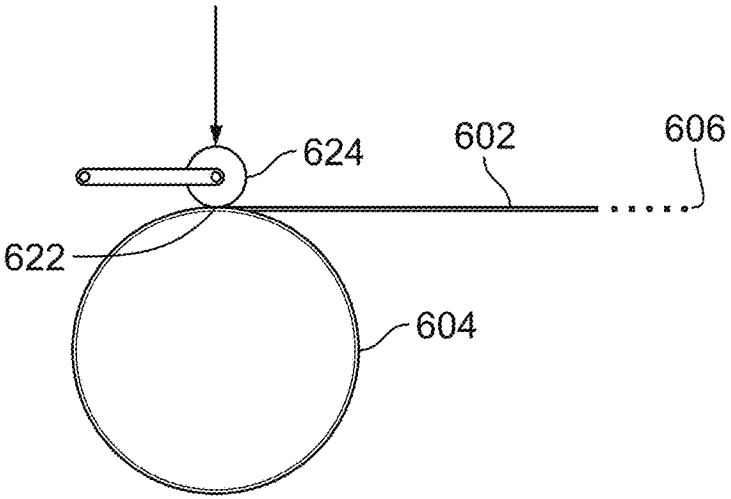
FIG. 6B illustrates an embodiment of a roller on a spool.
Figure 6A:
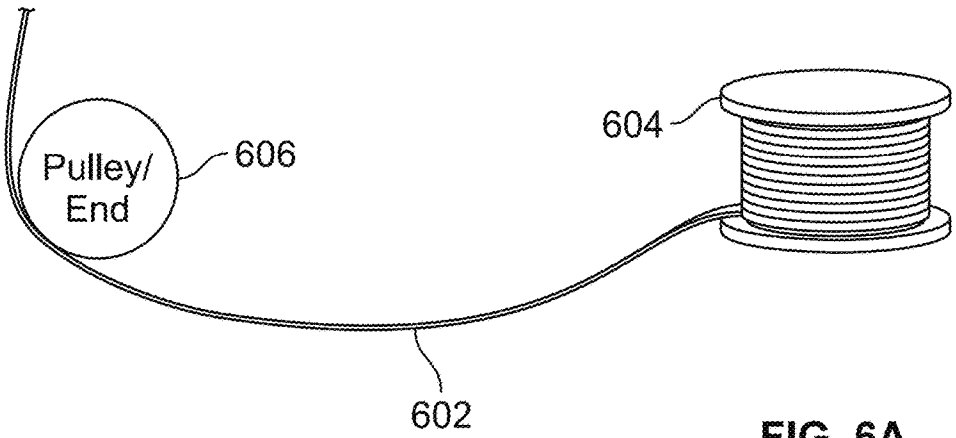
FIG. 6A illustrates an embodiment of a slack condition within an exercise machine.

FIG. 6A illustrates an embodiment of a slack condition within an exercise machine. As shown in FIG. 6A, the line (602) is wrapped around a spool (604), and coupled to a line end, wherein a line "end" is referred to herein as the next pivotal point for the line, which may be a pulley and/or an actuator.

Described below are various embodiments of techniques that may be used to prevent a line slack condition. For example, line tensioners and/or line guides may be used, examples of which are described below.

Fishing Reel. One example of a tension system is a fishing reel-style system. In one embodiment, the spool (604) or an external hub includes a part that travels back and forth during the spooling to guide the line (602) onto the spool (604) in a controlled manner.

Roller on Spool. In one embodiment, a roller on a spool (604) is used to keep the line on the motor. In one embodiment, the roller is attached to the fishing reel-style system described above so that the line is prevented from bundling up.

FIG. 6B illustrates an embodiment of a roller on a spool. In one embodiment, a variable sized spool (604) may be used, for example, a two-step spool with different radii for the two different sections of the spool, where the line (602) may be directed to either the larger or smaller part of the spool depending on whether high speed or high torque is desired, similar to a multi-speed bicycle gearing system.

As shown in FIG. 6B, for a line (602) and a spool/motor (604), there is a point (622) along the spool that the line takes a tangent from the spool to lead towards the line end (606), for example, a line pulley. As referred to herein, this is the tangent point (622) of the spool. In a preferred embodiment, the tangent point (622) is where to position a roller (624) to reduce the likelihood of a line (602) escaping the spool (604) inducing line jamming, line friction, and/or line wear.

Guide/Cover. In one embodiment, a guide or cover (not shown in FIG. 6B) is placed along the spool (604) to prevent the line (602) from becoming lost, and to ensure that if the line (602) collects, it is collecting on the spool (604). In a preferred embodiment, the guide/cover would be placed at or near the tangent point (622).

In one embodiment, a tube for the line to travel in is included in the machine. In one embodiment, a cover is placed along the sides of the spool so that the line cannot escape. In one embodiment, the pulley covers are used to keep the line on pulleys. The use of a line tray/guide prevents a line from becoming knotted up or tossed around inside of the trainer/platform.

Take-up Mechanism. In one embodiment, a take-up mechanism is included in the platform, at least in part by providing an internal tension on the line.

In one embodiment, the platform includes a spring-loaded component that is able to change the line path length such that when there is slack, which increases the line path length, the spring-loaded component takes up the slack. When the line is under tension, the component attempts to straighten out the line. An example of such a take-up component is a belt tensioner.

Figure 6C:
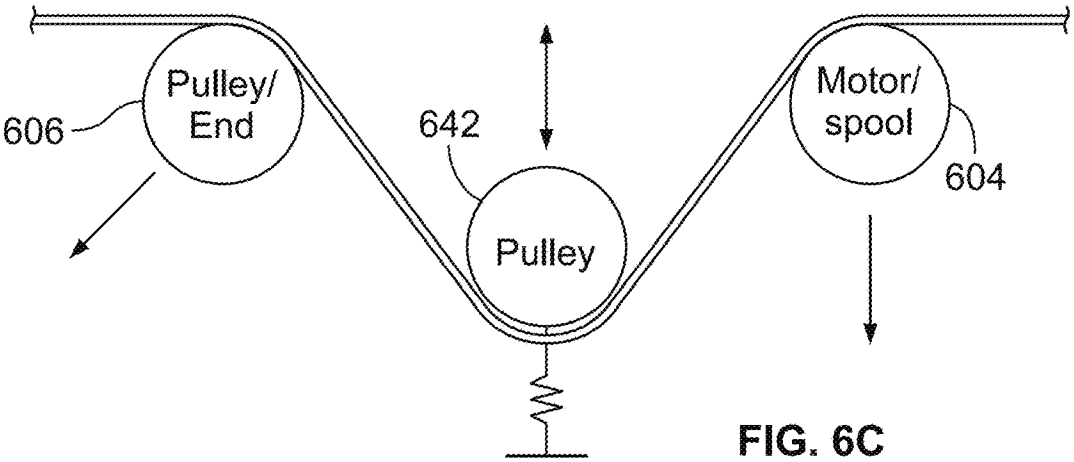
FIG. 6C illustrates an embodiment of a belt tensioner.

FIG. 6C illustrates an embodiment of a belt tensioner. In this example, motor/spool (604) is mounted horizontally within the platform. As shown in FIG. 6C, pulley (642) routes the line out of to a line end/pulley (606) which may include an exit point/portal of the machine. This pulley (606) may direct the line out of the horizontal plane, and up into the vertical plane, so for example that the user can pull upward on the line.

In this example, pulley (642) is an internal pulley to which a spring or spring-like mechanism is attached/connected. The spring may expand and retract, providing tension on the line and a passive retraction system. This provides an action similar to that of a rotary radial as the line is pulled in and out, which may change the length of the spring. When a slack event occurs where there is no tension on the line from the motor, the spring pulls on the pulley (642), increasing the line path. In this way, a nominal amount of tension in the line is maintained to ensure that the line (602) stays on the spool (604), and does not come off of the spool/motor (604), which may cause the line (602) to become tangled.

Another example of a take-up mechanism is a derailer. Another example of a take-up mechanism is a torsion spring and/or clock spring on the motor that passively spools the line. When the system is off, such take-up mechanisms hold tension on the line. For example, a clock spring or constant-force spring attached to the motor keeps passive tension on the line, even when power is off. Keeping passive tension on the line when power is off is an improvement for shipping considerations wherein the orientation of the spool/motor may be at any angle or change during shipping.

If a take-up mechanism prevents slack internal to the machine, then any line slack that does occur will be outside of the platform. The improvement of preventing slack internal to the machine is that a spooling issue internal to the machine is not readily accessible to the user. Using a take-up mechanism as described above, even if the user does move quickly creating a slack condition, the slack would occur external to the machine which could be resolved easily by a user without opening up the machine. This allows the use of a motor oriented at any angle including horizontal that is not affected by the occurrence of slack conditions.

In one embodiment, the minimum speed of the motor is made to be fast enough to keep up with spooling of the line. While there may be a tradeoff with lower speeds, the higher speed minimum allows for more tolerance and acceptance of line slack.

By using a horizontally mounted motor as described above along with slack reducing mechanisms described above, a low profile machine may be designed that allows for flexibility in the motor sizes that can be chosen, from low torque/high speed motors, to high torque/low speed motors. For example, small and large size motors may be used to provide different torque/speed tradeoffs, without compromising the height of the platform.

In one embodiment, when the motor is mounted horizontally, a pulley such as pulley (606) is mounted orthogonally to the motor so that the line may exit out of the top surface of the platform. In an alternative embodiment of mounting a motor in a horizontal plane and having a separate pulley that performs 90 degree translation so that the line can be vertically pulled out of the platform, a gearshaft may be put on the end of the motor that is 90 degrees, where a spooling system is then created off of the gear that translates the motion of the motor by 90 degrees. In this way, the motor rotates horizontally, but causes the line to spool vertically. For example, the motor spins in one direction, with a gear shaft coming off of the motor in another direction, allowing for vertical spooling. The vertical spool may be placed directly under a line exit point. Examples of such translation mechanisms include worm gears and bevel gears.

Wall Mounted Embodiments with Vertical Mounted Motors. Orientation of Motors within the Body of a Dual Motor Exercise Machine. The following are embodiments regarding installation, mounting, and placement of motors within the body of a dual motor wall-mounted weight training machine.

Figure 7:
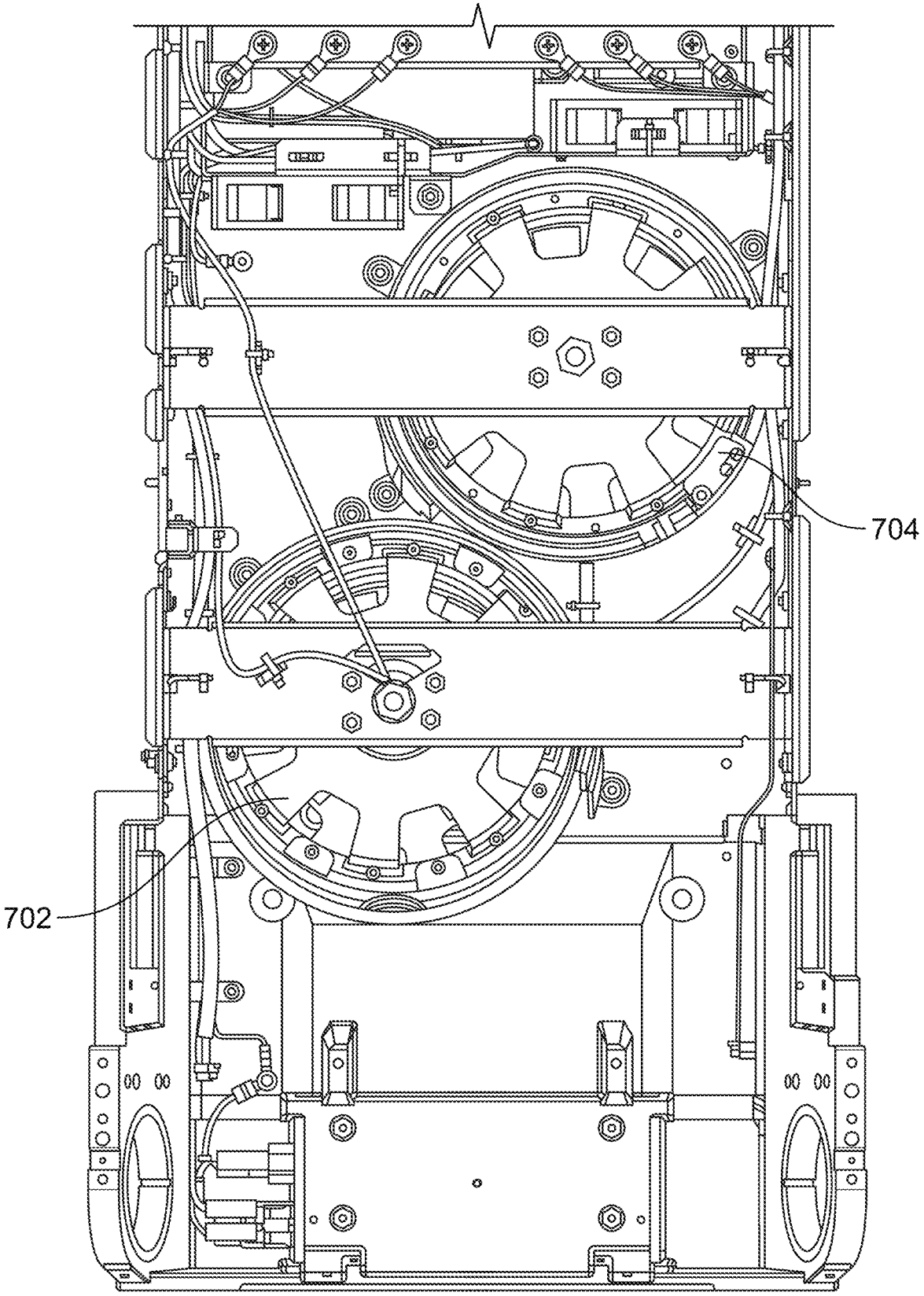
FIG. 7 illustrates an embodiment of dual motors in a chassis of a dual motor exercise machine.

Staggering of Dual Motors. FIG. 7 illustrates an embodiment of dual motors in a chassis of a dual motor exercise machine. As shown in this example, the motors (702) and (704) are oriented vertically, with one motor above the other. The motors (702) and (704) are also staggered. The staggered vertical stacking of the motors provides various benefits and/or improvements. For example, the volume utilized by the two motors is minimized, as compared to having them next to each other horizontally. This allows the body of the exercise machine to be more compact. The staggered orientation also allows the lines coming off of the motors (702), (704) to be appropriately routed without conflicting with each other.

The following are embodiments of securing or mounting the motors to the chassis to improve repairability, serviceability, and manufacturability. In one embodiment, the chassis and motor are designed such that a motor slips into a recess, and a long-threaded shaft is dropped down through the center of the motor shaft to provide clamping. This allows single-sided access, without having to secure the shaft from both sides.

Figure 8:
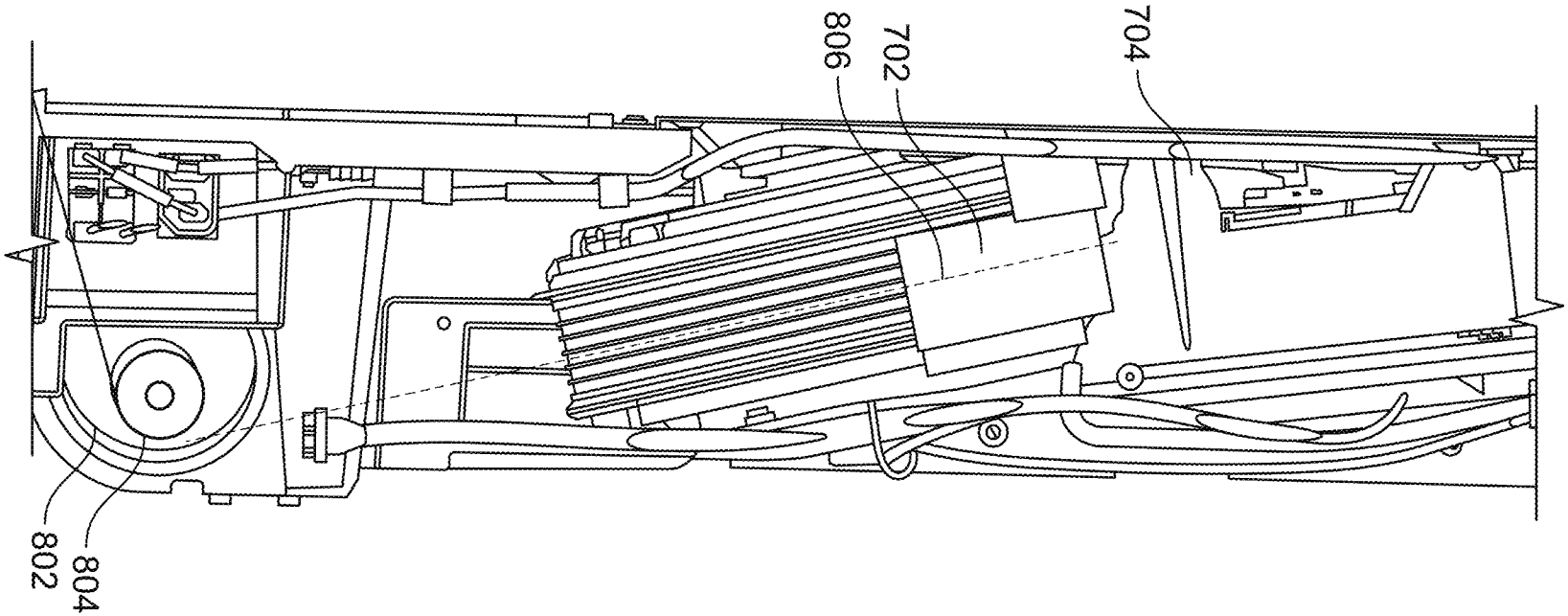
FIG. 8 illustrates an embodiment of mounting of the motors in the chassis of the exercise machine.

Skewing/Tilting of Dual Motors. FIG. 8 illustrates an embodiment of mounting of the motors in the chassis of the exercise machine. In this example, a side profile view of the internal structure or chassis of the exercise machine shown in FIG. 7 is shown. As shown in this example, the motors are tilted towards the back of the exercise machine (where the back of the exercise machine in this example is the side of the exercise machine that would be against a wall if the exercise machine were wall mounted).

In one embodiment, the motors are tilted to achieve a certain range of "fleet angle" of the cable, wherein fleet angle will be discussed further below. For example, the tilting of the motors affects the distance from where the rope or cable comes off of a spool/motor, down to pulleys at the shoulder areas (802) of the exercise machine, for example, a line end.

Taking motor (702) as an example, the cable on the spool of the motor exits through opening (802). In this example, because motor (702) is tilted, the cable will come off the spool/motor at an angle that is inline with shoulder (802). In this way, only a single pulley (804) is needed at shoulder (802) to guide the cable out of the shoulder and/or to the arm attached to the shoulder.

For example, if motor (702) were not tilted and the cable came off the spool downward, then an additional pulley would be needed to turn and guide the rope to the pulley at the shoulder. For example, a vertically oriented pulley at the bottom of the machine would be needed to turn or route the cable so that it can be directed to a horizontally oriented pulley at shoulder (802) that allows the cable to be directed out of the shoulder. By having the motors tilted, a single tilted pulley that effectively combines the two aforementioned pulleys may be used to allow the cable to exit the body of the exercise machine. In this way, the angle of the motor is inline with the pulley that directs the cable out of the body of the exercise machine.

In one embodiment, the motors may also be tilted side-to-side to facilitate the cable routing angles into, for example, angled shoulders. In one embodiment of a weight trainer, the shoulders of the exercise machine are angled to avoid a third degree of freedom for arm width adjustment.

Fleet Angle. As described above, the tilting of the motor allows the "fleet angle" of the cable to be within an acceptable range as it spools or unspools off of the motor. One example is a center line of the sheave (806) of the drum of the motor (702). The angle at which the line comes off of the center line of the sheave is referred to herein as the fleet angle. In one embodiment, for different ropes and cables, there is a minimum angle for the fleet angle that is not to be exceeded to prevent issues with how well the rope spools on the drum.

Figure 9A:
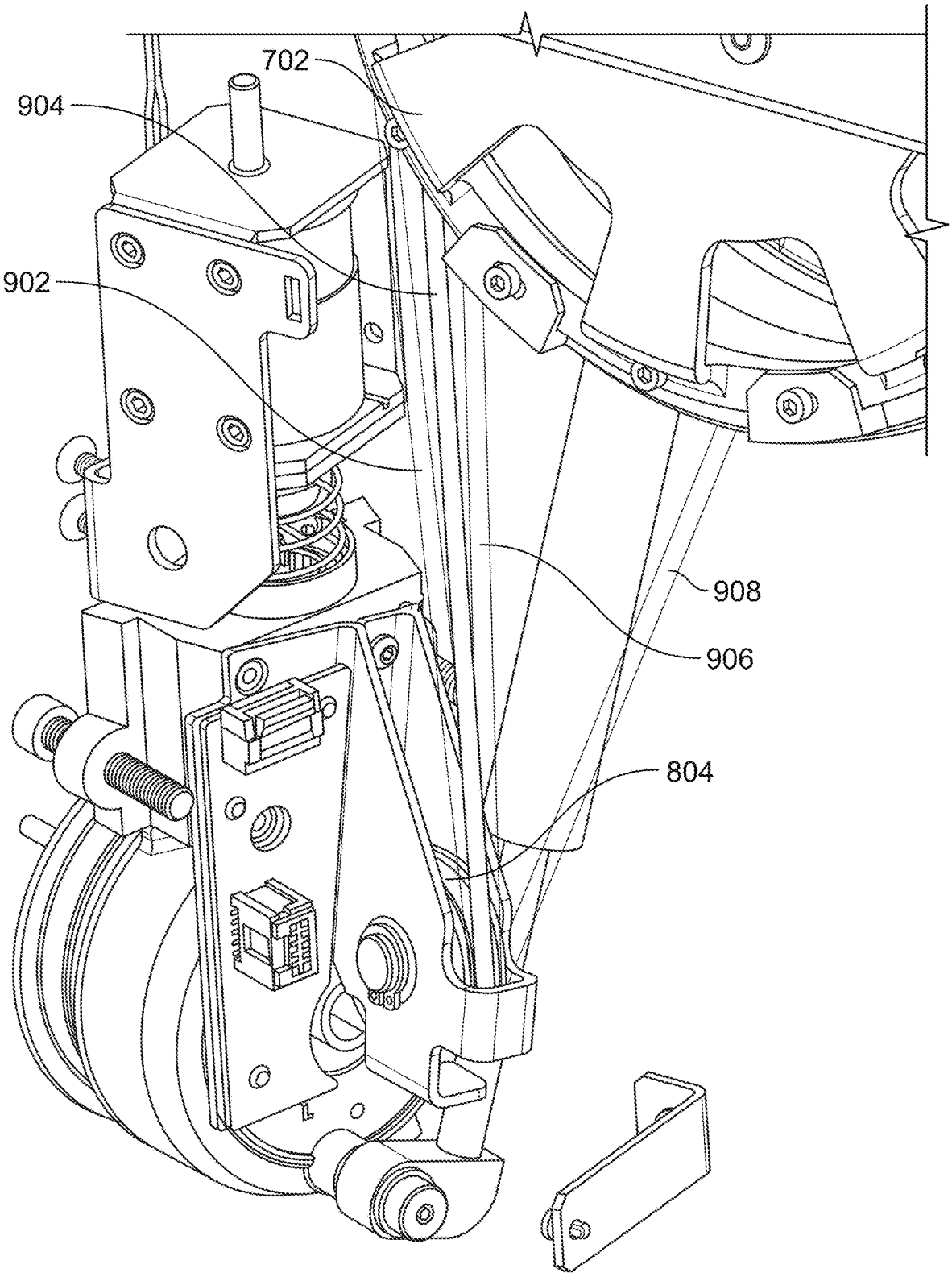
FIG. 9A illustrates an embodiment of fleet angles of a cable.

FIG. 9A illustrates an embodiment of fleet angles of a cable. Shown in this example are motor (702) and line end/pulley (804). As shown in this example, the angle at which pulley (804) comes out of the vertical axis of the body of the exercise machine provides the desired rope guidance. As shown in this example, both the pulley and the motor are tilted toward the back of the exercise machine, where if the exercise machine is wall-mounted, the back of the exercise machine is the side of the machine that is against the wall. This tilting of the shoulder exit pulley and coordinated tilting of the motor allows the rope or cable to come off of the spool/drum at fleet angles that are within a desired range of fleet angles.

Shown at (902), (904), (906), and (908) are illustrations or instances of the cable coming off the spool at different points of the spool. As shown in these examples, the cable comes off the spool at various fleet angles.

Figure 9B:
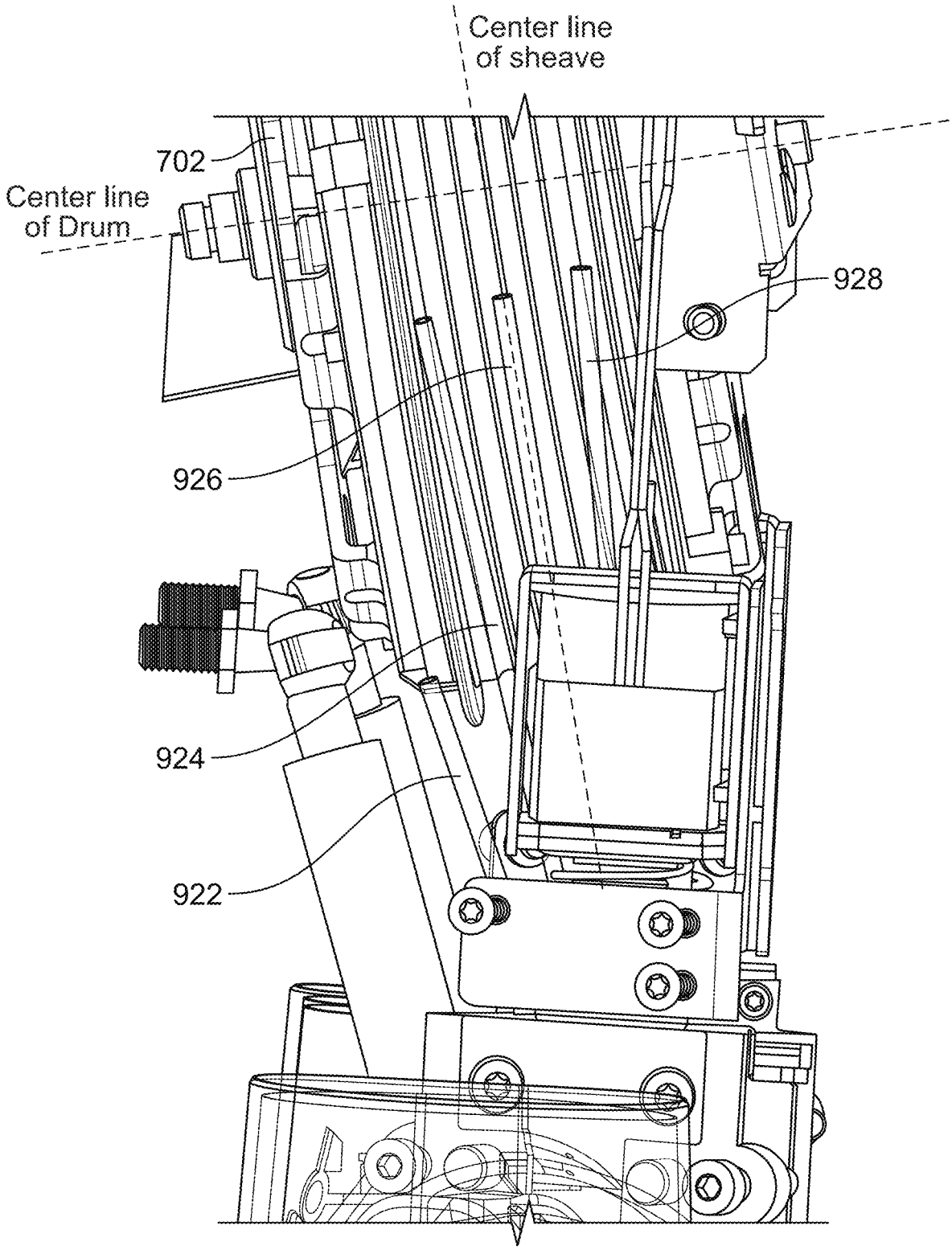
FIG. 9B illustrates an embodiment of fleet angles of a cable.

FIG. 9B illustrates an embodiment of fleet angles of a cable. In this example, a side profile view of motor (702) is shown. The angle of the rope is shown at various points (922), (924), (926), and (928) throughout its spooling. As shown in this example, as the rope spools or unspools, the fleet angle of the cable changes.

For example, when the cable is in the middle point of the spool at (926), the cable is at the center line of the sheave, with a fleet angle of zero degrees. At (924) is the point of spooling that illustrates the angle of the cable when the rope is near to being fully unspooled. At (922) the angle of the cable is shown when fully unspooled, and the line is hanging off of a knot where the rope is tied off to the structural portion of the motor. At (928) the angle of the cable is shown when fully spooled, for example, when the handles are retracted fully. As shown in this example, the fleet angle of the rope varies along the full range of actuator position/distance from the machine.

In this example, there is a single layer of cable wrapping across the depth of the drum. Having a single layer where the cable does not wrap over itself on the spool during spooling prevents issues such as rope click, jerking, and uncertain changes in diameter/mechanical advantage that would occur when the cable wraps over itself. In one embodiment, a helical line layering (not shown) is used where more than a single layer is used and where the line still does not wrap over itself on the spool excessively and without regularity, which also prevents issues such as rope click, jerking, and uncertain changes in diameter/mechanical advantage that would occur when the cable wraps over itself. Without limitation, the techniques described herein for a single line layer may be easily extended to a helical line layer scheme.

In one embodiment, there is only a single line layer, and thus a constant radius is being operated on compared to the cable. In an embodiment with a second line layer, this would increase the radius in the movement arm, where the amount of tension in the cable would change from the first wrap to the second wrap. In the case of a single line layer, there is a constant radius for the cross sections of the rope laying on a single constant layer. In one embodiment, the motor drum includes grooves to facilitate spooling.

As shown above, by angling the motor along with the pulley at the shoulder of the body of the exercise machine, the amount of fleet angle between where the cable meets the spool is reduced, allowing improved ordering/spooling of the line.

Staggered Orientation and Fleet Angle. The staggered orientation of the dual motors in the body or frame of the exercise machine as shown in the examples of FIG. 7 and FIG. 8 has an effect on fleet angle. This is due to one of the motors being further from its shoulder than the other motor is to its corresponding shoulder.

Figure 9C:
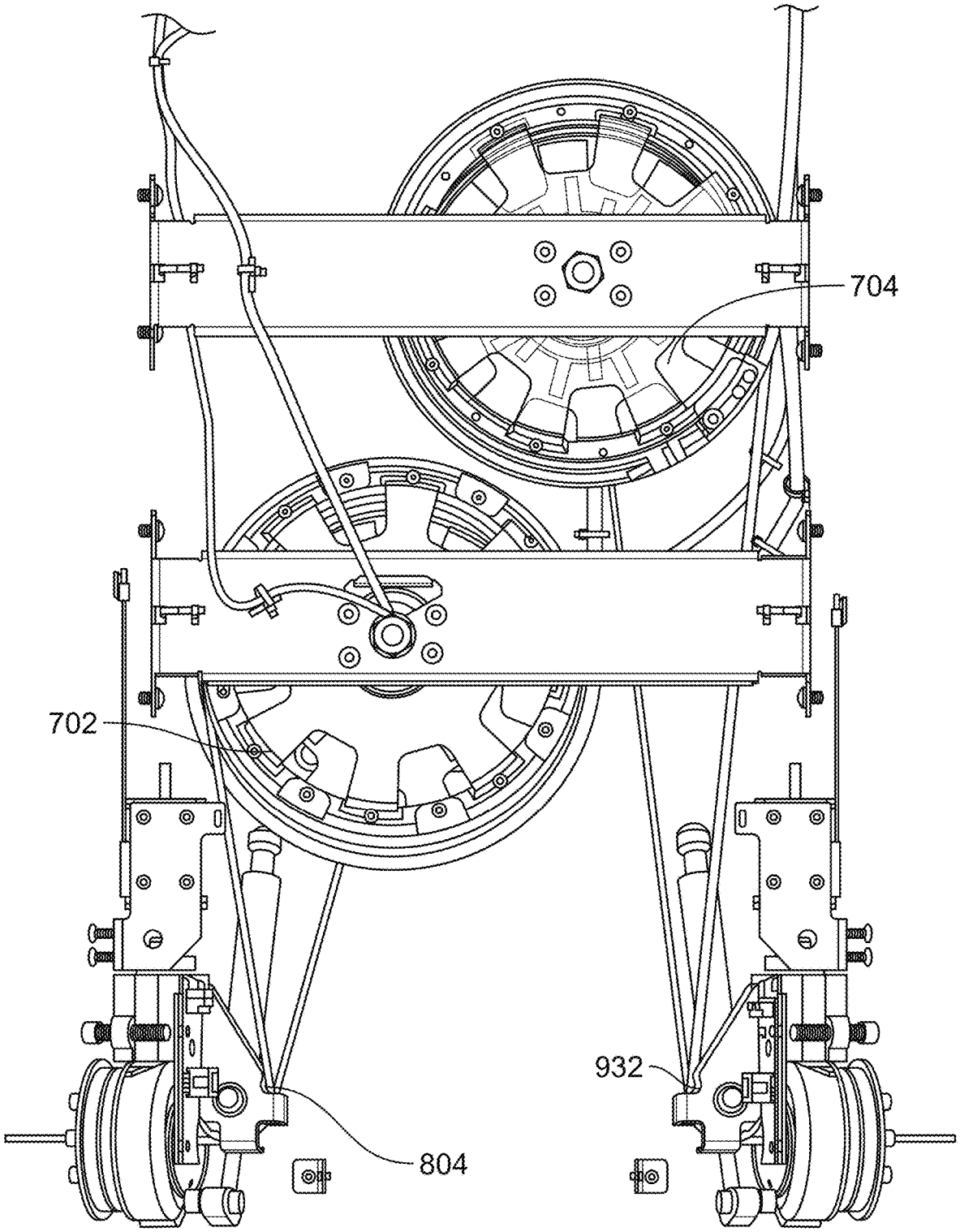
FIG. 9C illustrates an embodiment of a staggered dual motor orientation and fleet angles.

FIG. 9C illustrates an embodiment of a staggered dual motor orientation and fleet angles. Because motor (702) is closer to its corresponding pulley (804) than motor (704) is to its corresponding pulley (932), motor (702) has a wider fleet angle as compared to the fleet angle range for motor (704) as it traverses the width of its drum/spool.

Figure 9D:
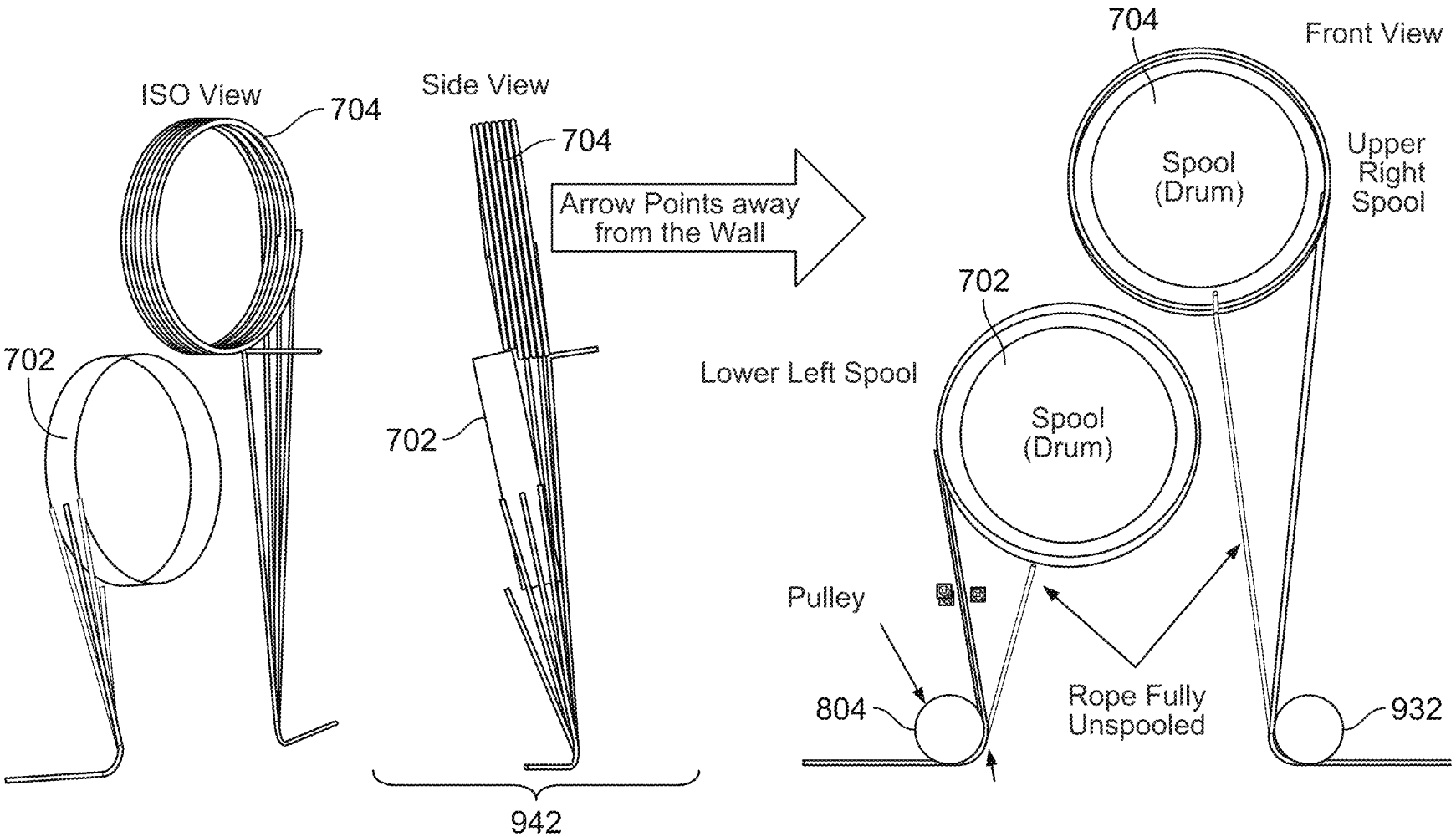
FIG. 9D illustrates an embodiment of fleet angles.

FIG. 9D illustrates an embodiment of fleet angles. In this example, an isometric (ISO) view, side view, and front view of the staggered dual motor orientation are shown. As shown in the side view (942), the cable on motor (702), wherein the motor is represented by the spools of the motor in this illustration, goes through a wider range of fleet angles than the cable on motor (704) goes through. For example, in one embodiment the cable on motor (702) may experience fleet angles of [~±4° ], while the cable on upper right motor (704) may experience fleet angles of [~±2° ].

The wider range of fleet ranges may cause cable routing issues for the closer motor (702). For example, because the motor (702) is close to where the rope hits the pulley and comes off, that fleet angle is much larger, which may impact whether the cable is properly spooling, even if the spool is grooved as described above. This is less of a problem for the higher motor (704) because of the greater distance to its corresponding pulley, resulting in a smaller range of fleet angles.

In one embodiment, to address such issues, the lower motor (702) is tilted at a different angle than the upper motor (704) is tilted. That is, the motor (702) and the motor (704) are skewed relative to and with respect to each other and may not be parallel to each other. In this way, the motor (702) is compensated for the desired fleet angle being exceeded. For example, motor (702) is tilted more than motor (704) to account for the wider range of fleet angles that will be experienced by the cable on motor (702).

Controlling for Slack Events. The following are embodiments of controlling for slack events. When the user moves outward faster than the motor can keep up, the motor may either keep constant torque and just let the user overpower and thus generate slack, or an algorithm controlling the motor may increase resistance to slow the user, such as an isokinetic mode. In one embodiment, if the user goes faster and then stops suddenly, the motor may overshoot as tension drops to zero. Now the user may experience a jerk when the motor catches up and starts retracting—in some embodiments, managing this jerk is also an effect of how fast the sensing is and how fast the control system can react.

For example, when a person performs an explosive movement, pulling the cable outwards, this motion may cause the rope to stand up and off of the spool/motor drum itself. In one embodiment, the system includes a line guide. In one embodiment, the line guide is used to contain any slack. In one embodiment, a secondary roller, for example over the spool/drum or where the line comes off the spool, is included that keeps the cable in place.

The following are further embodiments for controlling slack. Techniques for controlling slack using firmware or software may be used. A motor such as those described herein involves a rotating mass. In one embodiment, controlling for slack involves accurate determination of rotor position, inertia, and physics of the system to bring the rotating bodies of the motor to a stop quickly without slack spooling. If a slack event occurs, it is arrested into a small space.

In one embodiment, a rope tension sensor may be used to react quickly, where a direct torque sensor on the motor shaft and back electromotive force (BEMF) on the motor itself may take longer to sense the tension change due to the inertia of the motor. A similar case may occur when the user tries to move inward faster than the motor's maximum speed. In one embodiment, the machine is configured to distinguish high dynamic speed movements from a user dropping the handle.

In one embodiment, once the motor spins outwards, for example, because the user pulls on a cable, due to inertia of the rotating mass of the motor, the motor may continue to spin unless another force brings it to a stop. For example, suppose that a user is performing a chop movement, as an example of an explosive movement. This causes the motor to accelerate outwards. Even though the user will abruptly stop their motion, because the motor has inertia, it may continue to spin on its own, causing slack of the cable to be generated within the exercise machine, as well as some additional slack that comes outside of the arm.

Detecting and controlling slack events is disclosed. In one embodiment, the determination of whether a slack event has occurred and whether the user has stopped pulling on the cable is determined by evaluating the acceleration of the motor itself using an internally embedded encoder. In the example chop movement described above, or any high power moves with high velocity movements, the user pulls out the line and then suddenly stops. Because of the inertia of the motor, the motor continues to spin outwards in a direction corresponding to the cable being pulled out, where the inertia is overcoming the torque of the motor that is being applied in a direction corresponding to reeling in of the cable. That is, the inertia is causing the motor to turn in a direction that is different from the direction that the motor is pulling. Because the user is no longer pulling on the cable, and the end of the cable that the user is holding onto is no longer moving, there may be no tension on the cable momentarily. This may result in the cable becoming slack, that is a slack event occurs.

This slack event is detrimental for various reasons. For example, the slack event may cause extra cable to come off the motor, which may become tangled with other componentry of the system. The slack event may also cause an uncomfortable feel for the user. For example, the cable may have no tension for a period of time, but the rotation of the motor may transition to a point such that it is reeling the cable in, and there may be a sudden amount of tension of the cable, resulting in a potentially uncomfortable feeling of whiplash or jerk for the user.

As the motor is still being controlled to reel in the cable, and it was the user's force causing the cable to unspool/and the motor to turn outwards, with the user no longer pulling on the cable, the motor's requested torque, which is applied in the inward direction to spool up the cable, may counter the outward spinning due to inertia, and cause the motor's rotation to decelerate. In one embodiment, the system monitors for such deceleration, which may have a characteristic profile if it is due to a slack event. For example, the motor may decelerate in other situations, which would have different deceleration profiles.

Detecting or inferring a deceleration profile that corresponds to a potential slack event is disclosed. In one embodiment, the deceleration profile of the motor is determined based on the known inertia of the system and the amount of torque that is being requested from the motor.

As described above, in the example of a chop, when the user pulls and then stops, the motor will continue to spin outward, the direction of its unspooling, due to its inertia. In this scenario, because the user has stopped pulling, the rope may not be tight, and may continue to be let out, resulting in a potential slack event. Because there is still torque being requested from the motor in the inward direction, the direction of spooling, the motor may begin to decelerate. Based on the known inertia of the motor and the requested torque, the profile of the deceleration is determined.

In one embodiment, the system monitors for motor deceleration. However, as described above, deceleration of the motor may occur for various reasons. For example, the deceleration may be due to a lack of tension on the line, for example because of an exercise such as the chop described above, which would lead to a slack event, or it may be due to the person slowing down, for example, transitioning from the concentric to eccentric phase of a repetition. The deceleration profiles for these two scenarios may be different. The lack of tension on the line may cause a slack event, and in order to detect the occurrence of a slack event and in order to compensate for it, in one embodiment the system monitors for a type of deceleration that corresponds to a lack of tension on the cable.

For example, the system detects a deceleration of the motor. The inertia of the motor and the amount of applied torque are determined. Based on the inertia of the motor and the applied torque, it is then determined whether the observed deceleration is due to a lack of tension, or for some other reason, such as due to transitioning between the concentric phase and the eccentric phase. If it is determined that the observed deceleration is indicative of a lack of tension, and thus, a slack event, torque compensation is triggered in response.

In one embodiment, in response to detecting that the profile of the deceleration corresponds to a potential slack event, the system is configured to compensate for the slack event by injecting additional torque to reel the cable in and prevent slack from generating. For example, the motor is instructed to increase its torque in the direction to reel or pull in the cable onto the motor. That is, torque is being applied in the opposite direction to how the motor is rotating due to inertia which when the user stops pulling, the motor is still rotating outwards in the direction of unspooling due to that inertia.

As described above, in one embodiment the system detects a slack event based on the profile of the deceleration of the motor. For example, when a user suddenly stops pulling on the rope (which may cause a slack event to occur), this may cause the motor to decelerate in a manner with a certain set of characteristics. That is, the profile of the deceleration is determined to indicate whether the cable is being manipulated in a manner that is likely to result in a slack event. Other deceleration profiles for other types of cable manipulations that result in slack events may also be monitored for. That is, if a user performs a movement that results in a sudden stopping of pulling on the rope, which causes a lack of tension on the cable, this may result in a slack event. The sudden cessation of pulling on the rope may result in a distinctive signature or pattern or amount of observed deceleration of the motor. The system detects whether sudden cessation of pulling on the rope has occurred by detecting whether a corresponding deceleration profile has occurred.

In one embodiment, as described above the motor is evaluated. It is determined that the motor is spinning in the opposite direction to the torque that is being applied. The motor may decelerate as that applied torque overcomes inertia, for example motor rotation changes direction and rewinds or reels the cable in. Deceleration of the motor is detected. When a person lets go, the crossover velocity, where the angular velocity changes sign, is determined, including the deceleration. This deceleration profile is different from the profile of the deceleration that would occur if a user is switching from a concentric to eccentric phase, where they are extending the cable, and after being at the top of the motion, the cable is returned inwards so that it is being retracted into the arm.

In this case, the deceleration profile may be different because in the case of a user going from the top of the rep and back down, there may still be a force acting on the motor opposing the torque—for example a user is pulling out, but then letting cable in, in which case a slack event is unlikely, as there is still tension on the cable—versus in the case of the user suddenly letting go, there may suddenly be no user force acting on the motor opposing the torque, which results in a sudden absence of tension on the cable, and leading to potential slack events as the cable would continue to unspool. If the deceleration profile corresponding to sudden loss of cable tension because the end of the cable that the user is holding suddenly stops moving is determined based on the known inertia of the motor and the known amount of torque that the motor is being requested to provide, then it is detected that a slack event may occur and should be compensated for.

In one embodiment, the amount of torque that is injected to compensate for slack events is tunable. For example, the amount or magnitude of torque and/or the duration or length of application of the torque is adjustable. For example, the compensation may be applied quickly, resulting in an abrupt sensation. The compensation may also be applied in a more gradual manner by adjusting the application of compensation torque. That is, the torque compensation is tunable for feel or stiffness.

As described above, detection of a slack event is determined by detecting a motor deceleration profile. The slack event is compensated for by applying a compensating amount of torque. The torque compensation is tunable to provide different feel, by adjusting the magnitude and duration of the torque compensation.

For example, the stiffness of the system may be adjusted so that the cable does not suddenly go from having no tension to having tension, when the motor decelerates beyond the point where it is now rotating in the direction that causes the cable to reel in. For example, consider a traditional weight stack machine. Suppose that the user suddenly pulls on a cable attached to the weight stack, causing the weight stack to suddenly rise up. As part of performing the explosive movement, the user stops pulling abruptly. The weight stack would become weightless and the cable would have no tension. The weight stack, due to gravity, would then start returning to the ground, where at some point the cable will suddenly go from having no tension to having tension. This would cause the user to feel a jerking sensation. While this could not be controlled in a traditional weight stack machine, in the dual motor system described herein, the torque compensation may be applied, based on adjusting magnitude and duration, such that such jerking is reduced or minimized or otherwise controlled.

Figure 10A:
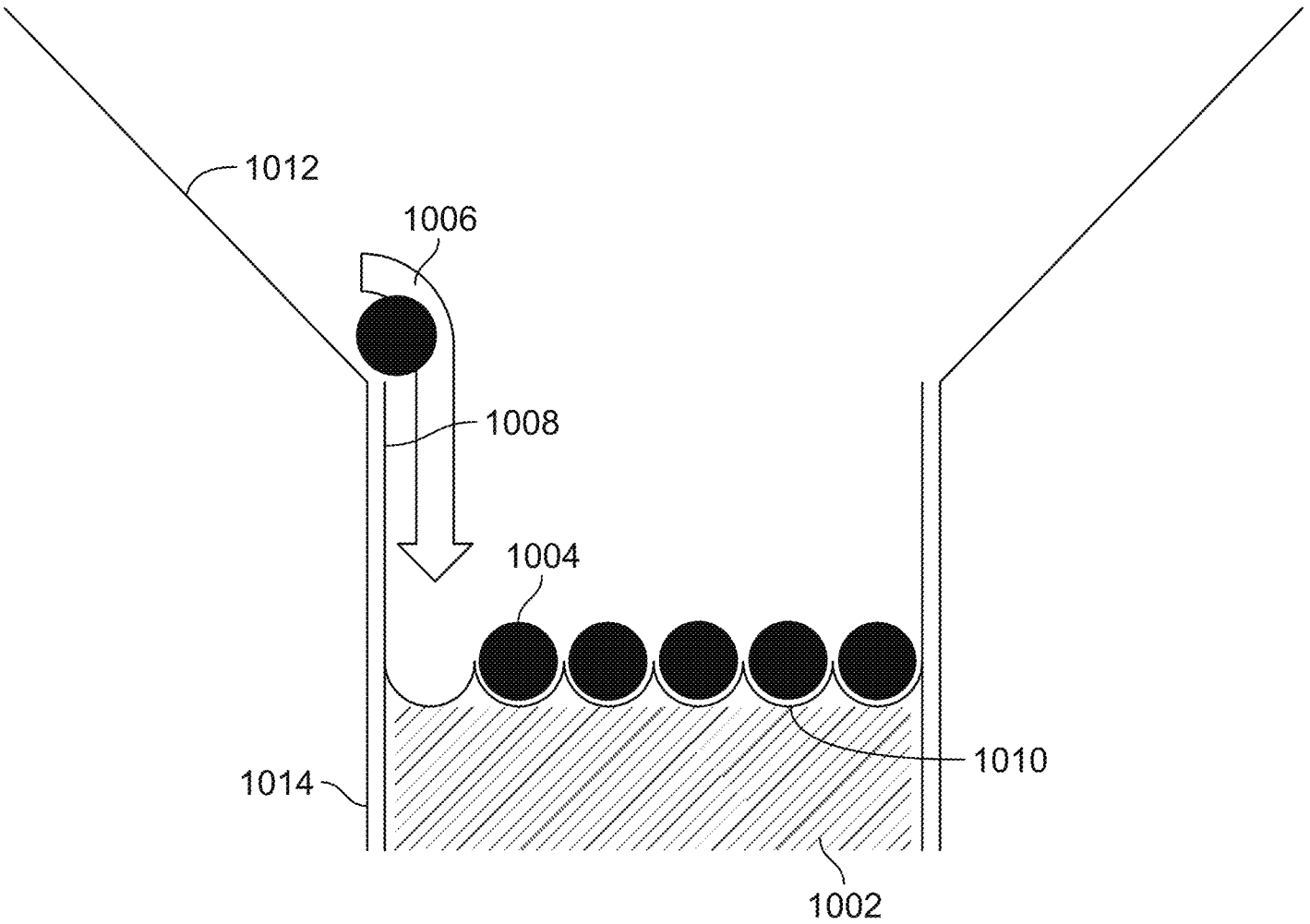
FIG. 10A is a cross-sectional illustration of an embodiment of a weight training machine that reduces slack for a vertical or angled spool orientation.

Slack Effect Reduction for Vertical or Angled Spool Orientation. FIG. 10A is a cross-sectional illustration of an embodiment of a weight training machine that reduces slack for a vertical or angled spool orientation. As referred to herein, an angled spool orientation is one where the axis of the spool and/or motor is oriented at an angle between vertical orientation and horizontal orientation. In one embodiment, the machine of FIG. 10A is an embodiment of that machine shown in FIG. 1, FIG. 2, FIG. 4, FIG. 7, FIG. 8, and/or FIGS. 9A-9D.

As shown in cross-sectional illustration FIG. 10A, a motor (1002) is coupled to a line (1004), (1006), such that the line is tensioned by the motor. Without limitation, the motor (1002) may be directly or indirectly coupled to the line (1004), (1006), and in FIG. 10A is directly coupled. Part of the coupling may be a spool (1008), (1010) that takes up the line (1004), (1006). As FIG. 10A is a cross-sectional illustration, there are parts of the line taken up around the spool (1006) and parts of the line (1004) not taken up in a slack/transitory position at a given instant in time during a line slack condition.

As FIG. 10A is a cross-sectional illustration, the spool may include a region for the line to be taken up (1010). In one embodiment, this part of the spool (1010) may be helical and/or spiral grooved to bias the line as it is taken up to reduce the chance of a line crossing over itself and binding/jamming/tangling in the event of a line slack condition, as is shown in FIG. 10A. Without limitation, this part of the spool (1010) may not be grooved. The spool may include a spool flange (1008) to define a capture region for the line. As referred to herein, a capture region is any region that the line is biased to being taken up within to reduce the chance of a line binding/jamming/tangling in the event of a line slack condition. For example, as shown in FIG. 10A, a capture region for a vertical or angled spool orientation includes the region inside the spool flange (1008) rather than outside the spool flange, where a line may bind/jam/tangle with other parts of the machine.

As shown in FIG. 10A, a line guide (1012) is designed adjacent to the spool, wherein the line guide prevents the slack portion of the line (1006) from persistently escaping from the capture region for the line. For example, as shown in FIG. 10A, the line guide (1012) is sloped towards the inside of the spool flange (1008) such that gravity force and/or inward axial force exerted by the motor to take up the line does not persistently escape from the capture region and wrap around the motor axle (1014) outside the spool for example and instead towards the capture region as shown by the hollow arrow in FIG. 10A.

In one embodiment, the line guide is part of a duct and/or other auxiliary structure of the machine concerned with other functionality. In one embodiment, the line guide (1012) is positioned parallel to the spool flange (1008), as shown for example in FIG. 10A. In one embodiment, the line guide (1012) comprises an axially-angled surface to funnel the line back to the capture region (1008) after an escape departure of the line. In one embodiment, the line guide (1012) and spool flange (1008) define a gap smaller than a diameter of the line, as shown for example in FIG. 10A, to prevent the line from slipping outside the spool flange (1008) to wrap around the motor axle (1014.)

Improvement of simply constraining the axial motion of the line so it does not slip outside the flange to wrap around the motor axle (1014) rather than constraining both axial and radial motion of the line includes a reduction of line friction that improves energy efficiency from less friction on the motor, an improvement in reduction of space required for slack control resulting in a more compact and/or lightweight machine, and an improvement in user experience of how a digital weight emulates a physical weight.

In one embodiment, the line guide directs the line axially, for example, the line guide (1012) shown in FIG. 10A that biases the slack portion of the line (1006) towards inside the spool flange (1008) and towards the spool (1010.) Another example of an axial line guide is a spring-loaded member such as a roller, sheet, and/or lever, that biases the line towards the inside of the spool flange (1008).

Figure 10B:
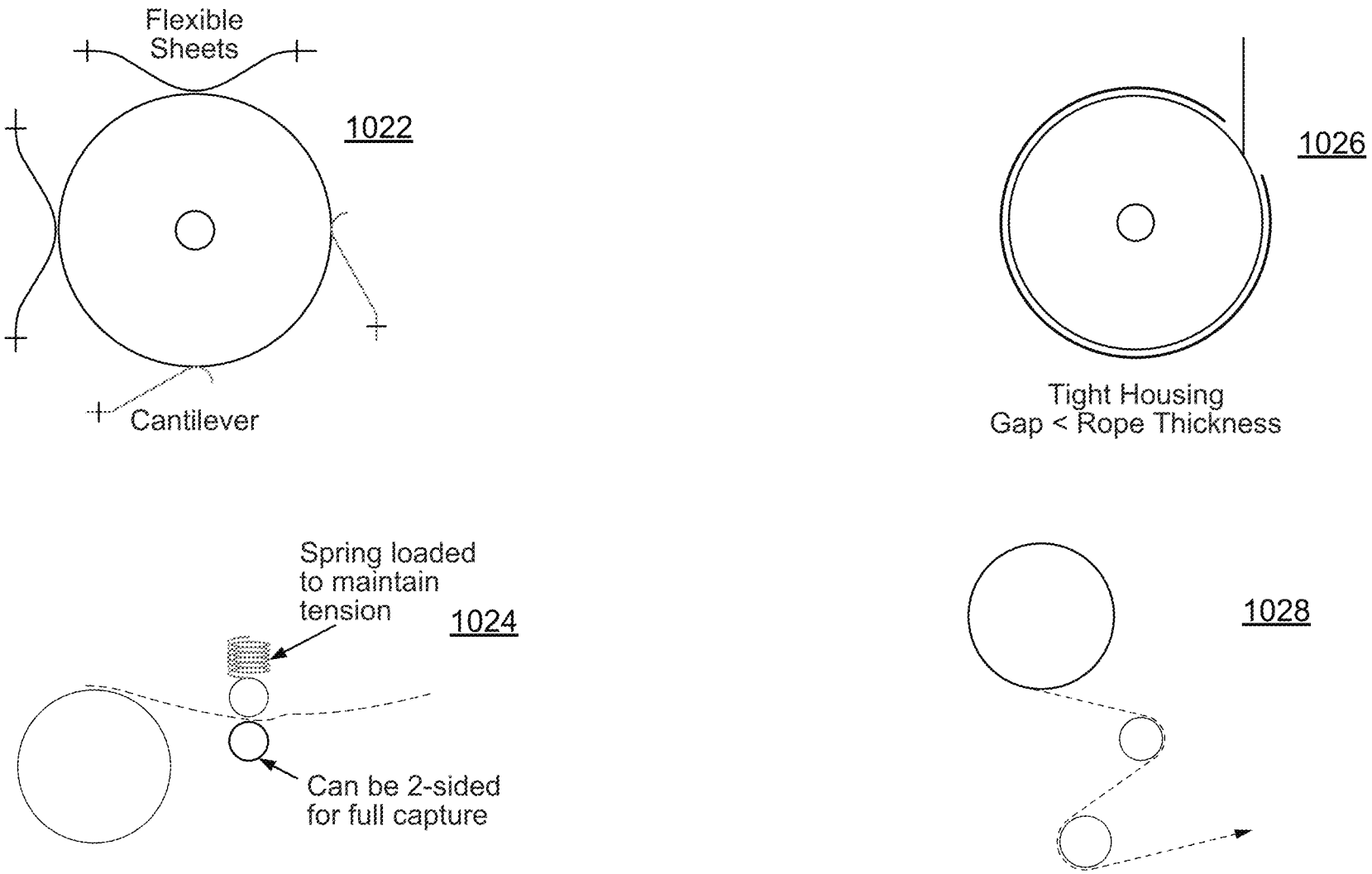
FIG. 10B is an illustration of embodiments of line guides.

FIG. 10B is an illustration of embodiments of line guides. As described also in FIG. 6B, line guides may be positioned at a tangent point (622) of the spool, for example, the position on the spool closest to a nearest line end. The tangent point may reduce likelihood of a line binding/jamming/tangling in the event of a line slack condition, and may reduce line friction and/or line wear effects. An improvement of reducing line friction is it reduces the drag on a motor, improving energy efficiency and/or reducing lag for a user that interferes with a natural exercise motion for digital weight emulation.

One axial line guide in FIG. 10B is flexible sheets and/or cantilevers (1022) that guide the line back towards inside the spool flange (1008). In one embodiment, these guides are placed closely/inline to the tangent point of the spool. Another line guide in FIG. 10B is a spring-loaded roller (1024) that maintains tension between a point in space outside the spool and the spool, such that the possibility of a line binding/jamming/tangling outside the spool flange and/or being wrapped around the axle (1014) is reduced. In one embodiment, the spring-loaded roller (1024) is complemented by another roller to provide a two-sided, full capture tension on the line. In one embodiment, the spring-loaded roller is positioned closely/inline with the tangent point of the spool.

Another line guide in FIG. 10B is a tight housing (1026) that so closely covers the end of the spool flange (1008) that the gap between housing and spool flange is smaller than the thickness of the line, reducing the possibility of binding/jamming/tangling the line outside the spool flange and/or being wrapped around the axle (1014). In one embodiment, the opening of the tight housing for the line to leave the spool is positioned close/inline to the tangent point (622) of the spool.

Another line guide in FIG. 10B is a plurality of rollers (1028) that maintains tension between a point in space outside the spool and the spool, such that the possibility of a line binding/jamming/tangling outside the flange and/or being wrapped around the axle (1014) is reduced. In one embodiment, the rollers are positioned closely/inline with the tangent point of the spool.

Figure 10C:
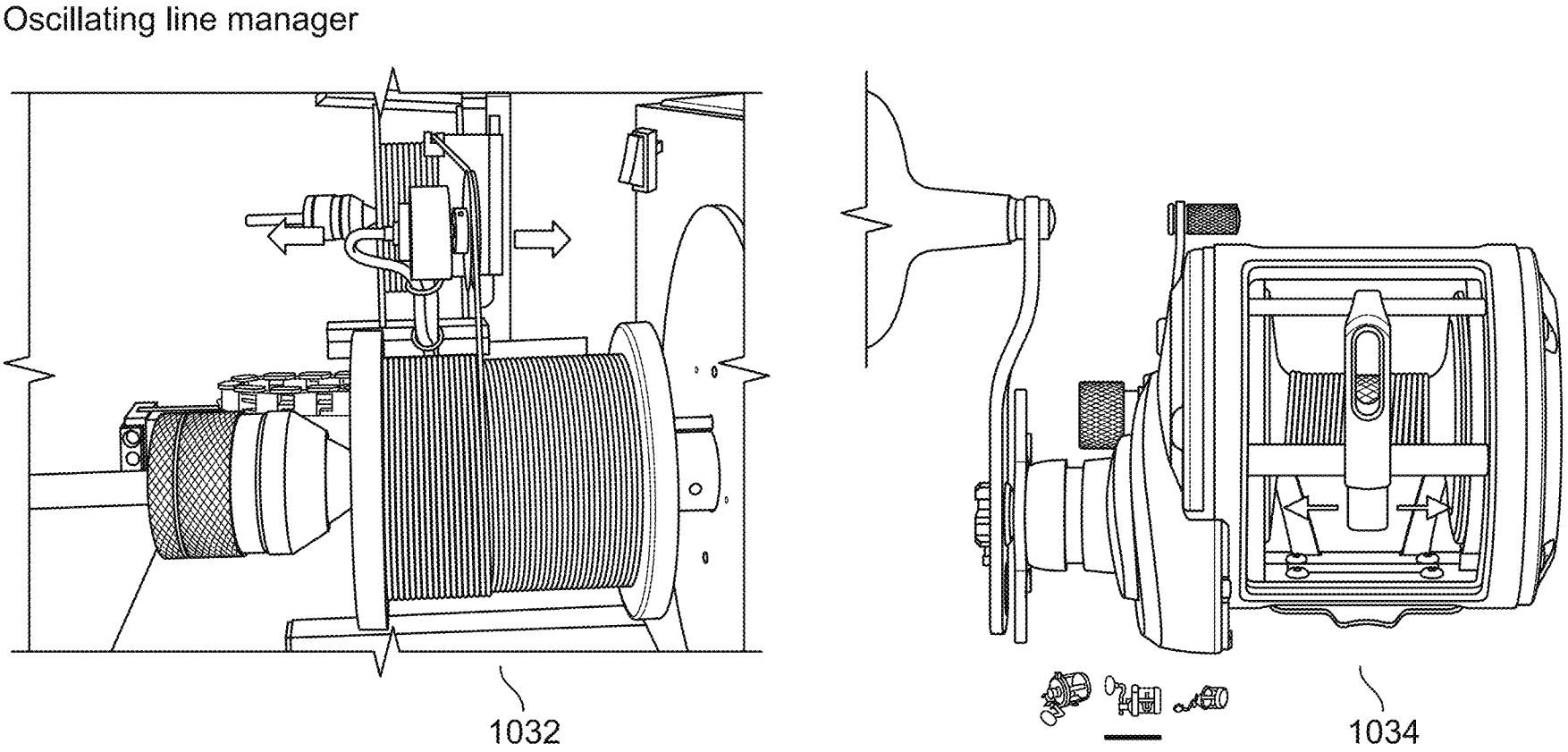
FIG. 10C is an illustration of embodiments of radial line guides.

FIG. 10C is an illustration of embodiments of radial line guides. In one embodiment, the line guide directs the line radially, for example, a portion of the grooving of the spool (1010) may be considered without limitation as part of such a line guide. Another example of a radial line guide may be an oscillating line manager (1032) analogous to a spinning reel for a fishing rod (1034) or a sewing machine line controller that keeps the taken up line in an orderly way, for example, using a helical/spiral order.

Figure 10D:
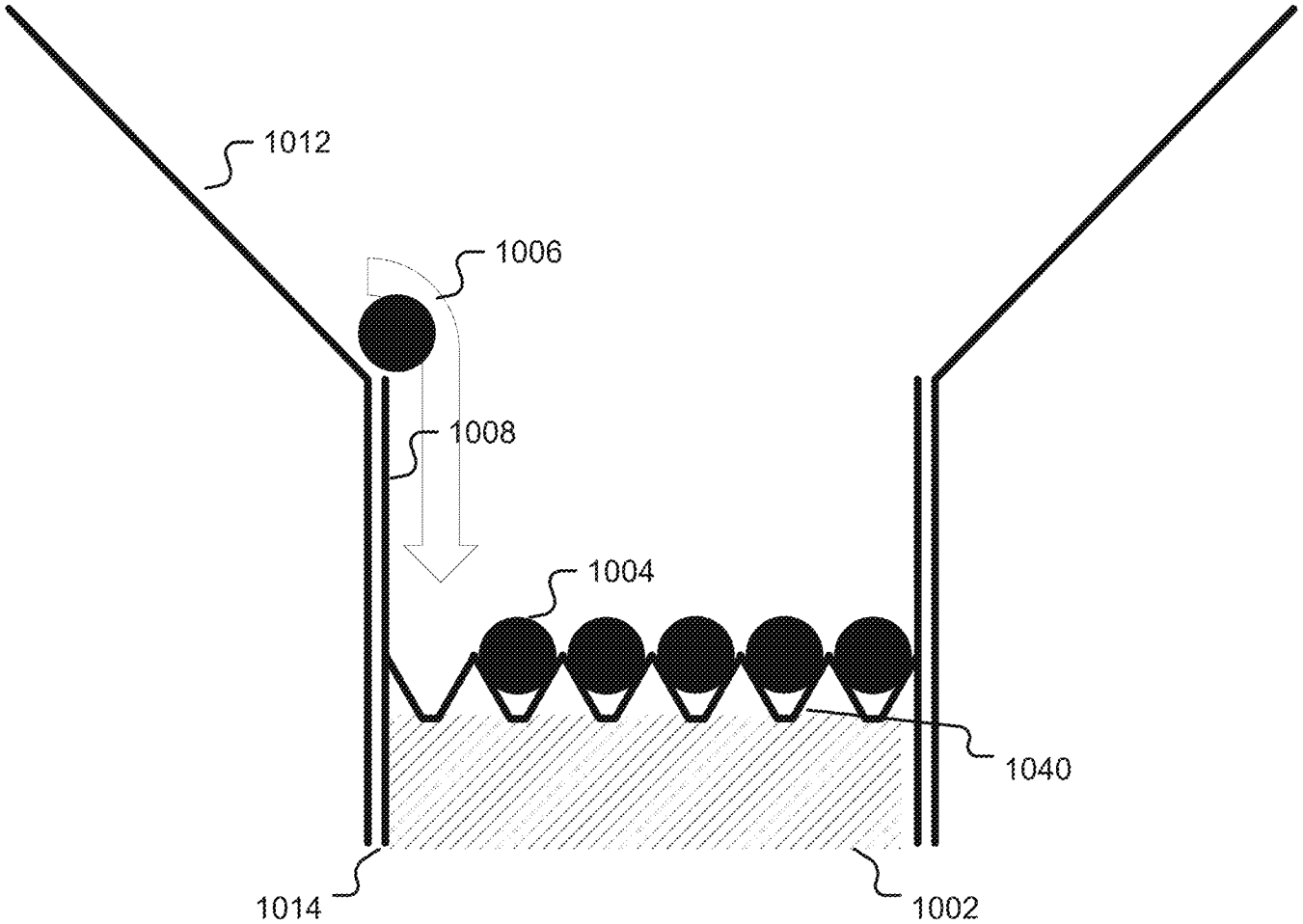
FIG. 10D is a cross-sectional illustration of an embodiment of a weight training machine that reduces slack for a vertical or angled spool orientation using line adhesion.

FIG. 10D is a cross-sectional illustration of an embodiment of a weight training machine that reduces slack for a vertical or angled spool orientation using line adhesion. In one embodiment, the illustration of FIG. 10D is similar to that shown of FIG. 10A but with a different spool groove (1010). As referred to herein, line adhesion allows a line to tangentially come off the spool more easily than it allows the line to come off radially from the spool. That is, the line can be fed off the spool, as is the case when the line is moving with lower momentum, more easily than it can fly off the spool, as is the case when the line is moving with higher momentum and the motor does not keep up.

In one embodiment, the line and/or spool is coated with an adhesive to keep the line stuck to the spool until it is fed off the spool. In one embodiment, the spool comprises a grooved surface (1040) that allows the line to come off tangentially from the spool easier than it allows the line to come off radially from the spool. In the example shown in FIG. 10D, the grooved surface (1040) may be angular or curved in a fashion to provide additional static friction in the radial direction for a line at rest on the spool (1008), and the surface (1040) may be coated with a low wear high friction coating to further improve line adhesion.

Figure 11A:
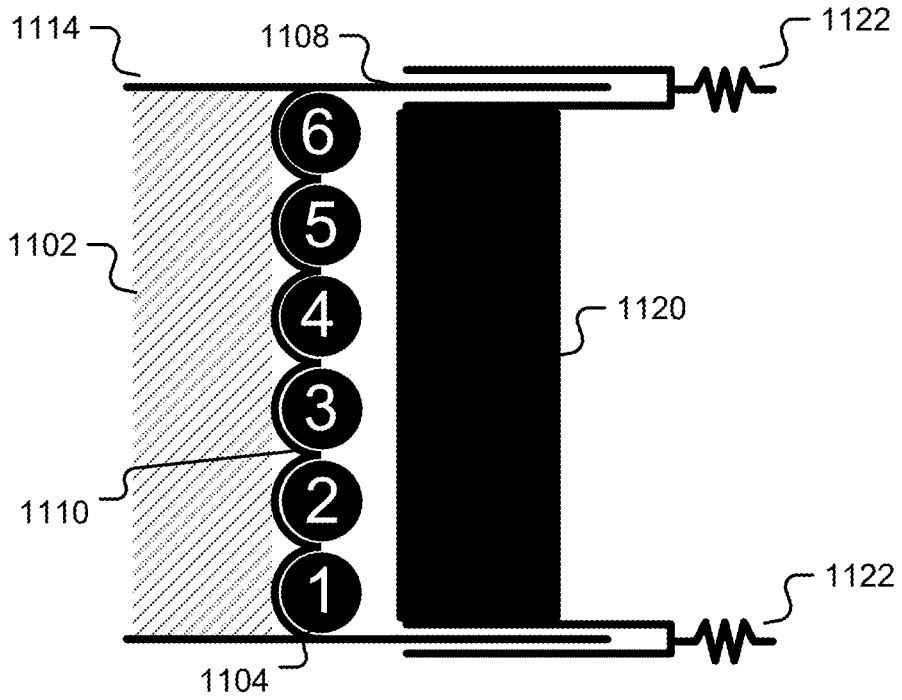
FIG. 11A is a cross-sectional illustration of an embodiment of a weight training machine that reduces slack for a horizontal spool orientation.

Slack Reduction for Horizontal Orientation. FIG. 11A is a cross-sectional illustration of an embodiment of a weight training machine that reduces slack for a horizontal spool orientation. In one embodiment, the machine of FIG. 11A is an embodiment of that machine shown in FIG. 1, FIG. 3, FIG. 5, and/or FIG. 6A. The techniques described for a vertical and/or angled spool orientation above and in FIGS. 10A-10D may also be used with a horizontal spool orientation, and may be enhanced with additional techniques to address that gravity does not provide a bias and/or force to keep the line within the spool.

As shown in FIG. 11A, a motor (1102) is coupled to a line (1104) such that the line is tensioned by the motor. Without limitation, the motor (1102) may be directly or indirectly coupled to the line (1104) and in FIG. 11A is directly coupled. Part of the coupling may be a spool (1108), (1110) that takes up the line (1104). As FIG. 11A is a cross-sectional illustration, there are parts of the line taken up around the spool and parts of the line (1104) not taken up in a slack/transitory position at a given instant in time during a line slack condition. As shown in FIG. 11A as a cross-sectional illustration, the cross sections of line (1104) are numbered to show the order in which a line is unwound off the spool, where "6" is the first part of the line unwound off the spool, then "5" is the second part of the line unwound off the spool, and so on. Without limitation, for simplicity six parts of the line are shown on the spool in FIG. 11A.

As FIG. 11A is a cross-sectional illustration, the spool may include a place for the line to be taken up (1110). In one embodiment, this part of the spool (1110) may be helical and/or spiral grooved to bias the line as it is taken up to reduce the chance of a line crossing over itself and binding/jamming/tangling in the event of a line slack condition, as is shown in FIG. 11A. Without limitation, this part of the spool (1110) may not be grooved. The spool may include a spool flange (1108) to define a capture region for the line. For example, as shown in FIG. 11A, a capture region for a horizontal spool orientation includes the region inside the spool flange (1108) rather than outside the spool flange, where a line may bind/jam/tangle with other parts of the machine.

A line guide in FIG. 11A is a roller (1120) that uses one or more springs (1122) to press against the line (1104) when against the spool (1110), such that the possibility of a line binding/jamming/tangling outside the spool flange (1108) and/or being wrapped around the axle such as the region (1114) is reduced. In one embodiment, the spring-loaded roller (1120) is positioned closely/inline with the tangent point of the spool. In one embodiment, the roller (1120) is surfaced with a compliant material such as rubber and/or soft foam, for example, to provide a robust surface against the line.

Figure 11B:
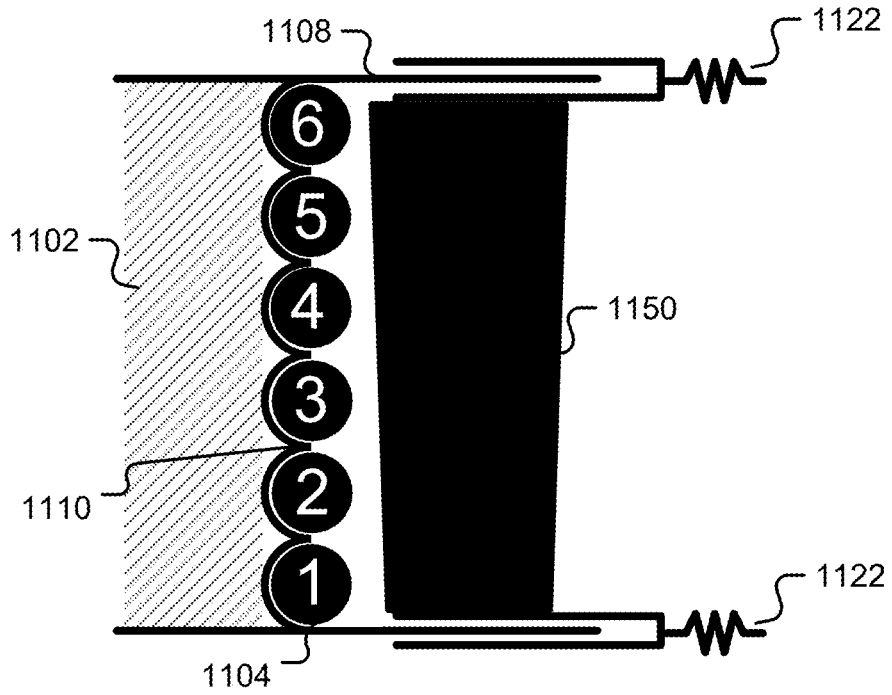
FIG. 11B is a cross-sectional illustration of an embodiment of a weight training machine that reduces slack for a horizontal spool orientation with a tapered roller.

FIG. 11B is a cross-sectional illustration of an embodiment of a weight training machine that reduces slack for a horizontal spool orientation with a tapered roller. In one embodiment, the illustration of FIG. 11B is similar to that shown of FIG. 11A but with a tapered roller (1150). As shown in FIG. 11B, the tapered roller (1150) reduces the contact between roller (1150) and line (1104). Thus, when fully wound, the line (1104) at point "6" is the only part of the line in contact with the roller (1150) so that points "5"-"1" are not in contact with the roller (1150). Then, when the line (1104) is unwound to point "5," that becomes the only part of the line in contact with the roller (1150) so that points "4"-"1" are not in contact with the roller (1150).

The improvement of a tapered roller (1150) from the reduced contact between line (1104) and roller (1150) includes a reduction in wear on the line (1104) and a reduction in motor friction, for example from the roller (1150). In one embodiment, the roller (1150) is surfaced with a compliant material such as rubber and/or soft foam, for example, to provide a robust surface against the line.

Slack while Shipping. A weight training machine may be transported and/or shipped to a home or business where the machine may be in any orientation and moving around the world in packaging. Typically no power is applied during shipping so that no motor control is available, yet it is important that a line is kept on a spool during shipping to prevent a non-functioning weight training machine upon delivery.

In one embodiment, a tensioner including a passive tensioner is used to apply a tension to the line during shipping to reduce the possibility of line slack. In one embodiment, the tensioner used is a geared tensioner analogous to a bicycle rear derailleur. In one embodiment, when power is applied to a weight training machine, the tensioner and/or passive tensioner is released to permit normal operation, analogous to an automatic head parking mechanism for a hard disk drive.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A weight training machine, comprising:

a motor;

a line that is tensioned by the motor;

a spool that takes up the line, wherein the spool includes a flange wherein the flange defines a capture region for the line; and a line guide adjacent to the spool, wherein the line guide prevents the line from persistently escaping from the capture region for the line, and wherein the line guide comprises an axially-angled surface to funnel the line back to the capture region after an escape departure of the line.

2. The weight training machine of claim 1, wherein the line guide directs the line axially.

3. The weight training machine of claim 1, wherein the line guide is part of a duct.

4. The weight training machine of claim 1, wherein the line guide is positioned parallel to the flange.

5. The weight training machine of claim 1, wherein the line guide and the flange define a gap smaller than a diameter of the line.

6. The weight training machine of claim 1, wherein the line and/or spool is coated with an adhesive to adhere the line to the spool.

7. The weight training machine of claim 1, wherein the spool comprises a grooved surface that allows the line to come off tangentially from the spool easier than it allows the line to come off radially from the spool.

8. The weight training machine of claim 1, wherein an axis of the spool is oriented horizontally.

9. The weight training machine of claim 1, wherein an axis of the spool is oriented at an angle between vertical orientation and horizontal orientation.

* * * * *